US006684414B1

(12) United States Patent
Rehrig

(10) Patent No.: US 6,684,414 B1
(45) Date of Patent: Feb. 3, 2004

(54) PORTABLE URINAL

(76) Inventor: Houston Rehrig, 1316 Abon La. #726, N. Ft. Lauderdale, FL (US) 33068

( * ) Notice: Subject to any disclaimer, the term of this patent is extended or adjusted under 35 U.S.C. 154(b) by 0 days.

(21) Appl. No.: 09/670,466

(22) Filed: Sep. 26, 2000

(51) Int. Cl.[7] ..... A47K 11/00
(52) U.S. Cl. ..... 4/144.1; 4/144.2; 4/144.3; 604/317; 604/347
(58) Field of Search ..... 4/144.1–144.4; 604/317, 346, 347, 349

(56) References Cited

U.S. PATENT DOCUMENTS

| | | | | |
|---|---|---|---|---|
| 231,487 | A | | 8/1880 | Henry et al. |
| 661,403 | A | | 11/1900 | Hogan |
| 1,337,829 | A | | 4/1920 | Doyle |
| 1,440,765 | A | | 1/1923 | Buckley |
| 1,657,975 | A | | 1/1928 | Shiells |
| 1,928,170 | A | | 9/1933 | Dwork |
| 2,182,254 | A | | 12/1939 | Farrell |
| D138,651 | S | | 8/1944 | Korotev et al. |
| 2,382,276 | A | | 8/1945 | Wells |
| 2,742,218 | A | | 4/1956 | Sullivan |
| 2,875,451 | A | | 3/1959 | Stegeman |
| 3,070,810 | A | | 1/1963 | Jones |
| 3,095,578 | A | | 7/1963 | Stanford |
| 3,432,864 | A | | 3/1969 | Schwartz |
| 3,473,172 | A | * | 10/1969 | Friedman et al. ..... 4/144.3 |
| 3,479,671 | A | | 11/1969 | Beich |
| 3,485,233 | A | | 12/1969 | Cord |
| 3,568,218 | A | | 3/1971 | Beckman |
| 3,781,922 | A | | 1/1974 | Ericson |
| 3,832,738 | A | | 9/1974 | Kliemann |
| 4,020,843 | A | | 5/1977 | Kanall |
| 4,090,541 | A | | 5/1978 | Cammarata et al. |
| 4,176,412 | A | | 12/1979 | Peterson |
| 4,187,562 | A | | 2/1980 | Mioduski |
| 4,189,789 | A | | 2/1980 | Hofstetter |
| 4,194,508 | A | | 3/1980 | Anderson |
| 4,202,057 | A | | 5/1980 | Ibarra |
| 4,221,295 | A | | 9/1980 | Tuchband et al. |
| 4,246,901 | A | | 1/1981 | Frosch et al. |
| 4,270,539 | A | | 6/1981 | Frosch et al. |
| D265,760 | S | | 8/1982 | Lahay |
| D265,927 | S | | 8/1982 | Lahay |
| 4,365,363 | A | | 12/1982 | Windauer |
| 4,387,726 | A | | 6/1983 | Denard |
| 4,393,881 | A | | 7/1983 | Shah |
| D274,469 | S | | 6/1984 | Huang et al. |
| 4,531,245 | A | | 7/1985 | Lowd et al. |
| D285,348 | S | | 8/1986 | Matthews |
| D288,608 | S | | 3/1987 | Dahlberg |
| 4,696,067 | A | | 9/1987 | Woodward |
| 4,771,484 | A | | 9/1988 | Mozell |
| 4,892,529 | A | * | 1/1990 | Valerio |
| 5,007,116 | A | | 4/1991 | Yamamoto |
| 5,009,236 | A | | 4/1991 | Brothers |
| 5,010,599 | A | | 4/1991 | Nilsson |
| RE33,686 | E | | 9/1991 | Parrish |

(List continued on next page.)

OTHER PUBLICATIONS

Ritter, Douglas S., Piddle Packs, The Aviation Consumer, Feb. 1, 1995.

*Primary Examiner*—Steven O. Douglas
*Assistant Examiner*—Amanda Flynn
(74) *Attorney, Agent, or Firm*—Brooks Kushman P.C.

(57) ABSTRACT

A portable urinal for collecting and storing urine from a user is provided. The portable urinal includes a receptacle for collecting the urine, where the receptacle includes a body portion having an inlet sized to sufficiently receive the genitourinary area of the user, and an outlet. The portable urinal further includes a storage container for storing the urine, where the storage container has an inlet for receiving the urine from the receptacle. A connector attached to the storage container receives the storage container inlet and removably receives the receptacle outlet, such that the connector releasably joins the receptacle with the storage container allowing the urine to flow from the receptacle outlet into the storage container inlet.

31 Claims, 22 Drawing Sheets

U.S. PATENT DOCUMENTS 5,049,144 A 9/1991 Payton
5,053,027 A 10/1991 Manfredi
5,065,459 A 11/1991 Tjahaja et al.
5,091,998 A 3/1992 Witzke
5,146,637 A 9/1992 Bressler et al.
5,147,342 A 9/1992 Kane et al.
5,197,957 A 3/1993 Wendler
5,235,705 A 8/1993 Belisle
D340,731 S 10/1993 Pollak et al.
D341,157 S 11/1993 Kitahara et al.
5,267,988 A 12/1993 Farkas
5,267,990 A 12/1993 Cross et al.
D348,315 S 6/1994 Hanifl et al.
5,329,644 A 7/1994 Scott
5,331,689 A 7/1994 Haq
5,358,148 A 10/1994 Hanifl
5,406,650 A 4/1995 Einbinder
5,445,292 A * 8/1995 Slomski et al. ..... 4/144.1
5,450,632 A 9/1995 Esswein et al.
5,457,823 A 10/1995 Mojena
5,505,717 A 4/1996 Moore
5,551,097 A * 9/1996 Short ..... 4/144.1
5,562,622 A 10/1996 Tihon
D376,201 S 12/1996 Norton
D378,129 S 2/1997 Wexler et al.
5,599,331 A 2/1997 Hemstreet et al.
5,647,670 A 7/1997 Iscovich
5,655,229 A 8/1997 Horn
5,687,429 A 11/1997 Rahiff
5,711,445 A 1/1998 Robbins, III
5,735,835 A 4/1998 Holland
5,741,240 A 4/1998 Olsen
5,792,127 A 8/1998 Marran
5,797,855 A 8/1998 Hazard et al.
5,842,233 A * 12/1998 Broden ..... 4/144.1
5,852,830 A 12/1998 Horn
D406,644 S 3/1999 Keppler
5,894,607 A 4/1999 Van Den Burg
5,894,608 A 4/1999 Birbara
5,913,832 A 6/1999 Sagalovich et al.
5,926,858 A 7/1999 Heller
5,957,904 A 9/1999 Holland
5,961,501 A * 10/1999 Cassidy et al. ..... 604/327
6,021,531 A 2/2000 Kirko
D425,982 S 5/2000 Wilkinson et al.
D425,983 S 5/2000 Wilkinson et al.
6,059,762 A 5/2000 Boyer et al.
6,065,726 A 5/2000 Pfaeffle
6,068,618 A * 5/2000 Anderson ..... 604/349
D426,302 S 6/2000 Wilkinson
6,070,275 A 6/2000 Garlock
6,079,057 A 6/2000 Mette
6,098,210 A 8/2000 Broden
6,109,441 A 8/2000 Anderson
6,119,280 A 9/2000 Rentsch
D449,105 S 10/2001 Azo
6,296,627 B1 * 10/2001 Edwards ..... 604/347
D450,118 S 11/2001 Hyde
D467,338 S * 12/2002 Rehrig ..... D24/122

* cited by examiner

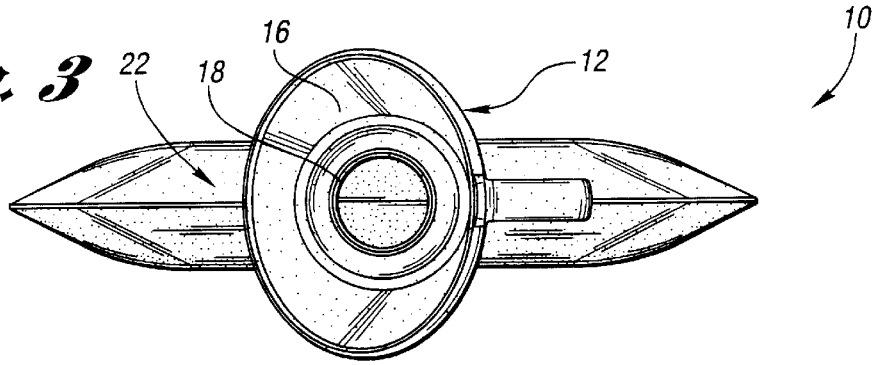
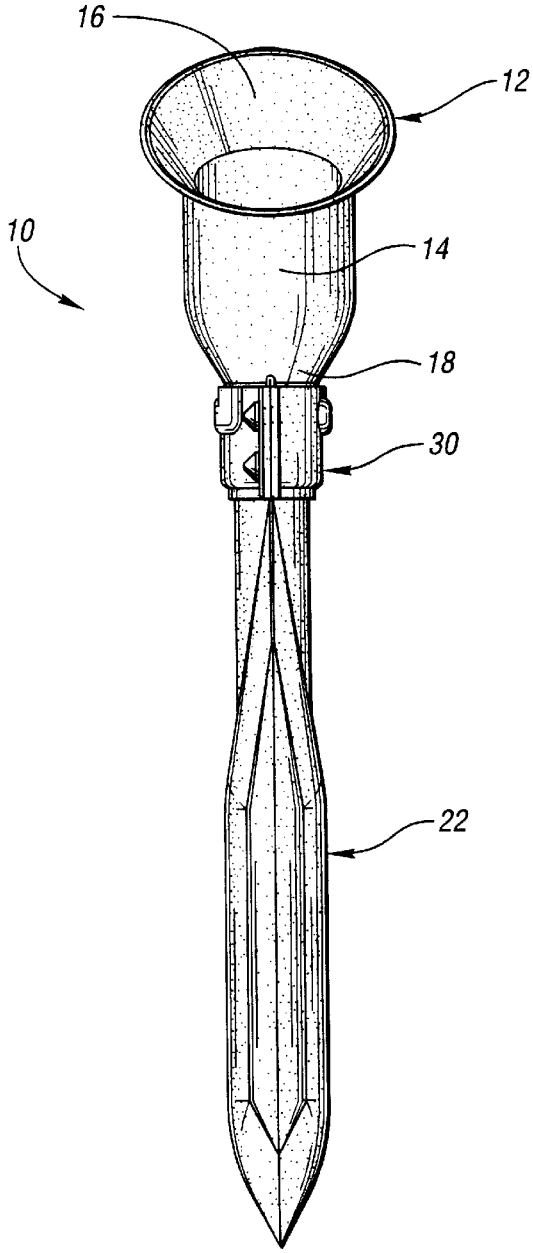
Fig. 4
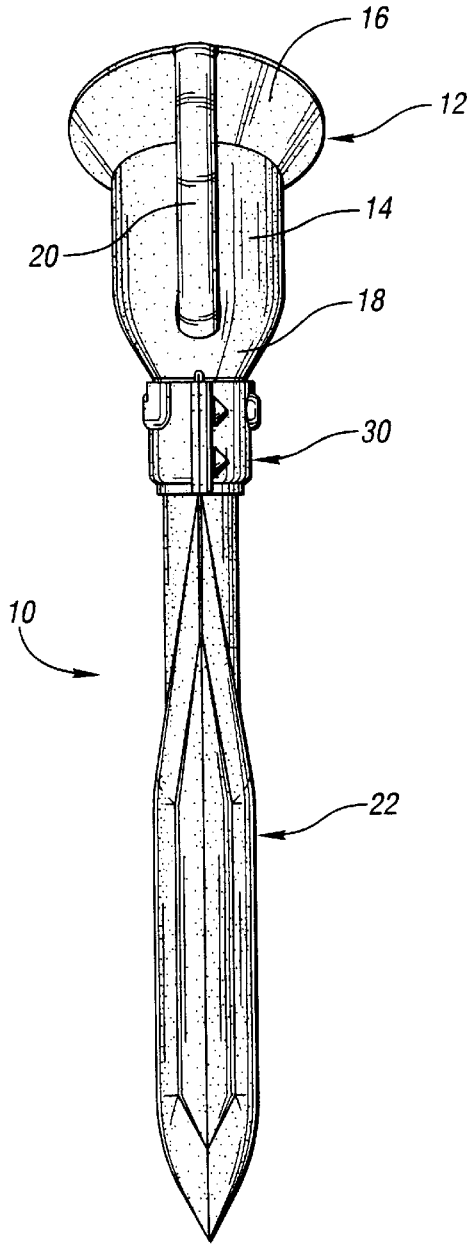
Fig. 5

PORTABLE URINAL

TECHNICAL FIELD

This invention relates to a portable urinal for collecting and storing the urine of a user.

BACKGROUND ART

Portable urinals provide users with a place to urinate when restroom facilities are unavailable or unreachable. There are many circumstances for which a portable urinal is helpful. For example, many people suffer from urinary incontinence, which requires that they often must quickly and unexpectedly reach toilet facilities. Other people may require the use of a portable urinal due to temporarily immobilization or other medical conditions which prohibit them from reaching the restroom without assistance. Still other people find portable urinals useful in common situations such as during long car trips or during traffic backups when restroom facilities cannot be reached in a timely manner. Even leisure activities such as camping, hiking, boating, or fishing can present situations where portable urinals are desirable.

Portable urinals come in a variety of sizes and configurations. Certain portable urinals are designed to be completely reusable. Such urinals are both economical and environmentally-friendly. However, reusing a portable urinal requires that all of its parts be sufficiently cleaned, which can be a time-consuming as well as unpleasant task. To avoid these problems, other portable urinals have been designed to be completely disposable. While more convenient, the cost of replacing the entire urinal after each use is a detriment.

As a compromise, some portable urinals have been configured to have both reusable and disposable parts. However, such portable urinals often suffer the disadvantages of being difficult to set up for use, or difficult to seal in order to retain the collected urine for later disposal.

Whether reusable or disposable, a portable urinal should be able to accommodate the different anatomical requirements of men and women. Typically, urinals are designed for use by only one gender. When urinals are intended to be unisex, urine collection is often not optimized for one gender or the other. In addition, many portable urinals are large and bulky, making them less discreet and detracting from their ease of portability.

DISCLOSURE OF INVENTION

Therefore, it is an object according to the present invention to provide an improved portable urinal which is easily assembled for urine collection and disassembled for urine disposal.

It is another object according to the present invention to provide a portable urinal in which urine can be easily and safely stored for later disposal.

It is still another object according to the present invention to provide a portable urinal capable of accommodating both male and female users.

Accordingly, a portable urinal is provided for collecting and storing urine from a user. The portable urinal includes a receptacle for collecting the urine, where the receptacle includes a body portion having an inlet sized to sufficiently receive the genitourinary area of the user, and an outlet. The portable urinal further includes a storage container for storing the urine, where the storage container has an inlet for receiving the urine from the receptacle. A connector attached to the storage container receives the storage container inlet and removably receives the receptacle outlet, such that the connector releasably joins the receptacle with the storage container allowing the urine to flow from the receptacle outlet into the storage container inlet.

In accordance with the present invention, the receptacle inlet can be sized to receive the genitourinary area of a male user, or can be sized to receive the genitourinary area of a female user. In a preferred embodiment, the receptacle is designed to be reusable, and the storage container is designed to be disposable. Preferably, the storage container includes a flexible bag which includes a powder substance contained therein for absorbing the urine. The receptacle body portion can also include a handle formed therein to improve ease of use.

The connector can either be press fit or welded onto the storage container. In order to releasably join the receptacle with the storage container such that the receptacle can be removed from the storage container, the receptacle outlet preferably includes at least one projection, and the connector includes at least one slot sized to slidingly receive the projection. The receptacle is then secured to the connector by rotating the receptacle with respect to the connector such that the projection is moved to an end of the slot.

In a preferred embodiment of the present invention, the portable urinal includes a cap adapted to be received by the connector for sealing the storage container following removal of the receptacle. The sealed storage container can then be disposed and replaced with another, unused storage container. Similar to the receptacle outlet, the cap preferably includes at least one projection, and the connector includes at least one slot sized to slidingly receive the projection. The cap is then secured to the connector by rotating the cap with respect to the connector such that the projection is moved to an end of the slot.

In one embodiment of the present invention, the receptacle outlet or, alternatively, a distal end of the cap is received in the storage container inlet. In another embodiment, the connector includes a bracket having first and second bracket members, and a funnel enclosed by the bracket. The first bracket member includes projections, and the second bracket member includes apertures sized to receive the projections to secure the first and second bracket members together. The funnel, in turn, includes an inlet portion for engaging the receptacle outlet and an outlet portion that protrudes below the bracket and is adapted to be received in the storage container inlet. Still further, the first and second bracket members include a set of internal flanges between which the funnel inlet portion is received such that axial movement of the funnel with respect to the bracket members is prohibited.

In further accordance with the present invention, a portable urinal kit for collecting and storing urine is provided. The kit includes a female receptacle for collecting urine from a female user, where the female receptacle includes a body portion having an inlet sized to sufficiently receive the genitourinary area of the female user, and a relatively smaller outlet. The kit also includes a male receptacle for collecting urine from a male user, where the male receptacle includes a body portion having an inlet sized to sufficiently receive the genitourinary area of the male user, and a relatively smaller outlet. Additionally, the kit includes one or more disposable storage containers for storing the urine, each storage container having an inlet for receiving urine from a selected one of the female and male receptacles. A connector is attached to the storage container inlet and adapted to receive the outlet of the selected receptacle, thereby allowing urine to flow from the selected receptacle outlet into the storage container inlet. The connector releasably joins the selected receptacle with the storage container such that the selected receptacle can be removed from the storage container. Lastly, the kit includes a cap adapted to be received by the connector for sealing the storage container following removal of the selected receptacle. In this way, the sealed storage container can be disposed and replaced with another, unused storage container.

The above objects and other objects, features, and advantages of the present invention are readily apparent from the following detailed description of the best mode for carrying out the invention when taken in connection with the accompanying drawings.

BRIEF DESCRIPTION OF DRAWINGS

FIG. 3 is a top plan view of the portable urinal of FIG. 1;

FIG. 4 is a left side elevational view of the portable urinal of FIG. 1;

FIG. 5 is a right side elevational view of the portable urinal of FIG. 1;

BEST MODE FOR CARRYING OUT THE INVENTION

Figure 1:
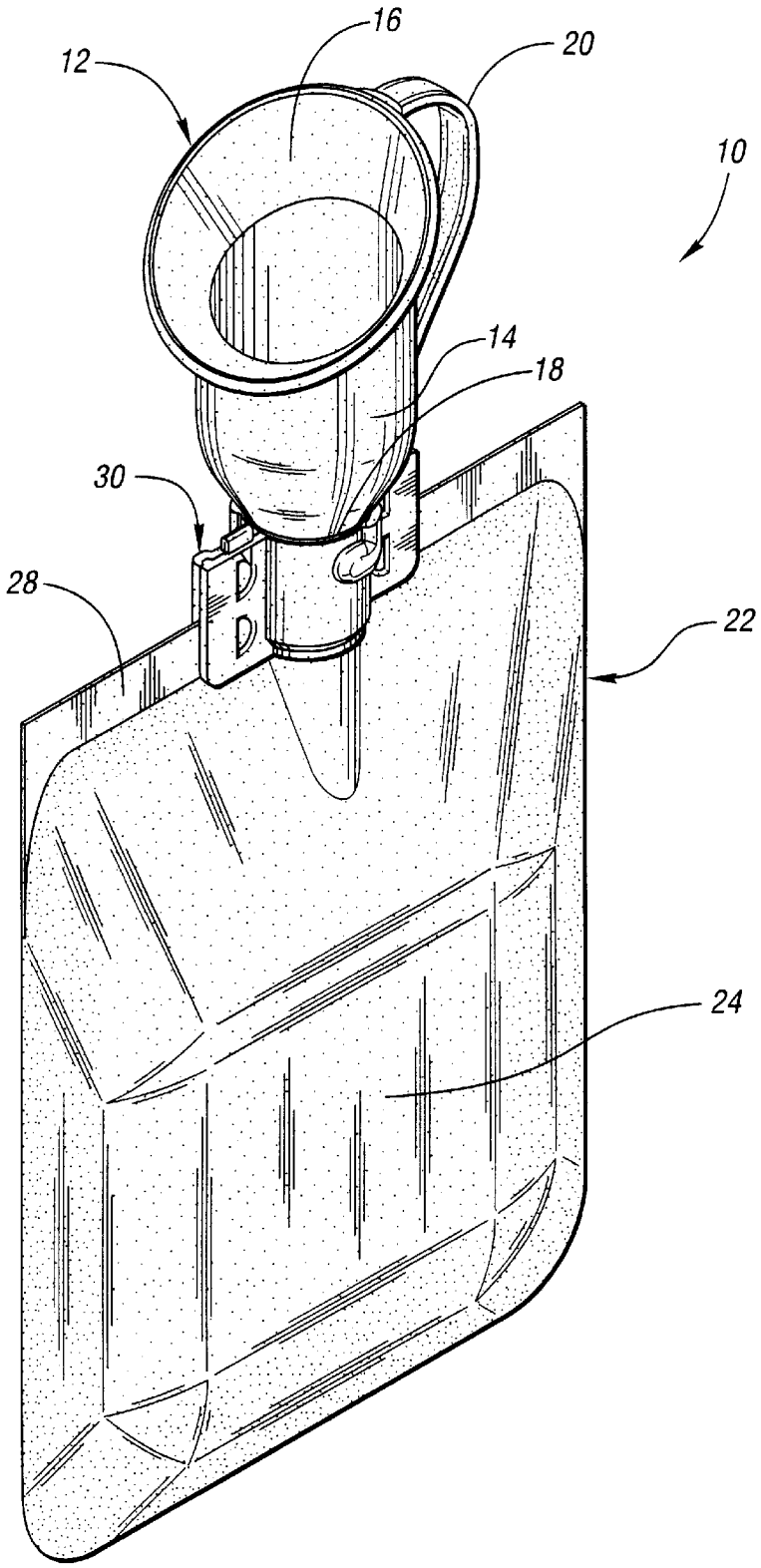
FIG. 1 is a perspective view of a first embodiment of a portable urinal in accordance with the present invention, wherein a male receptacle is utilized.
Figure 2A:
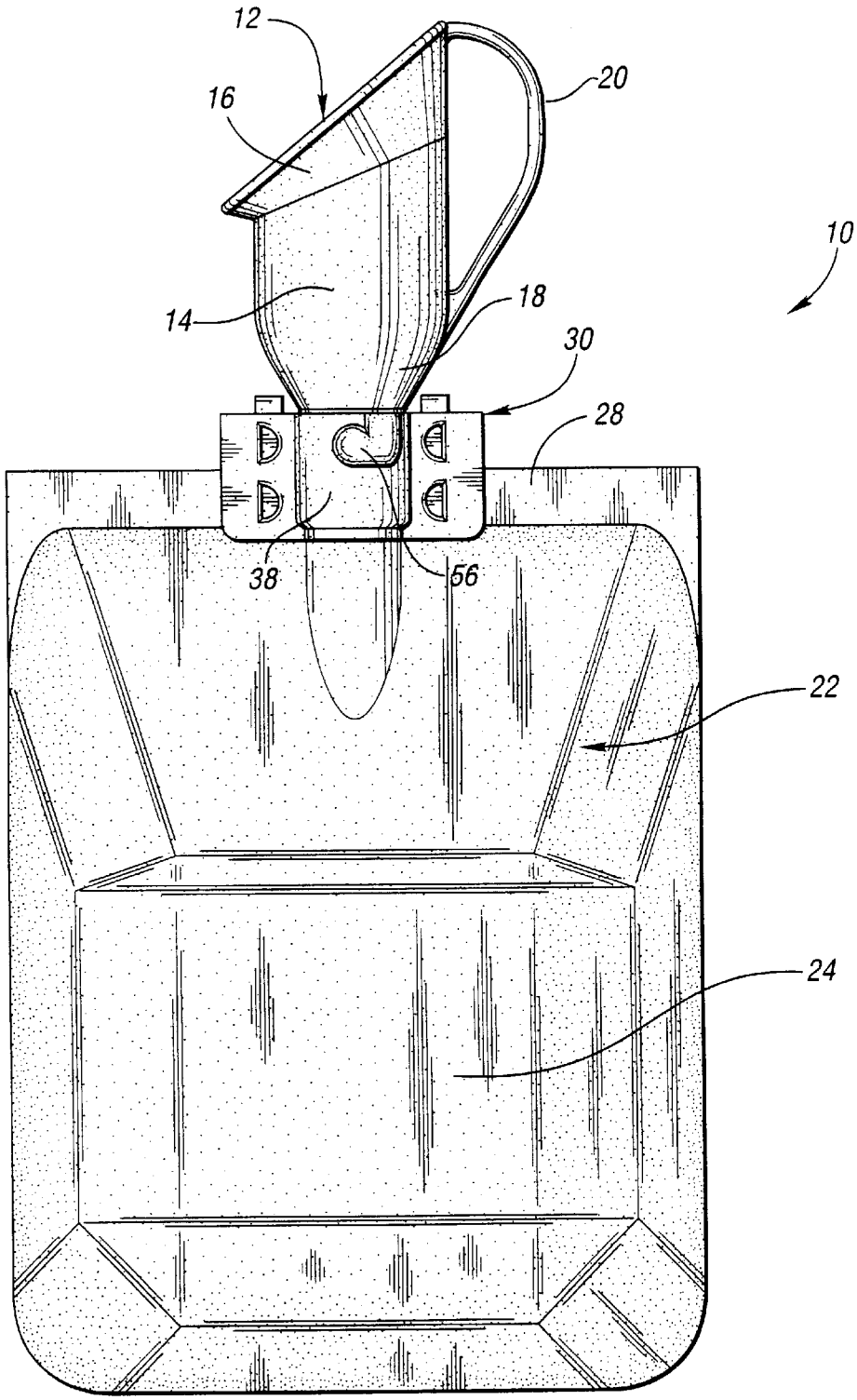
FIG. 2*a* is a front elevational view of the portable urinal of FIG. 1.
Figure 2B:
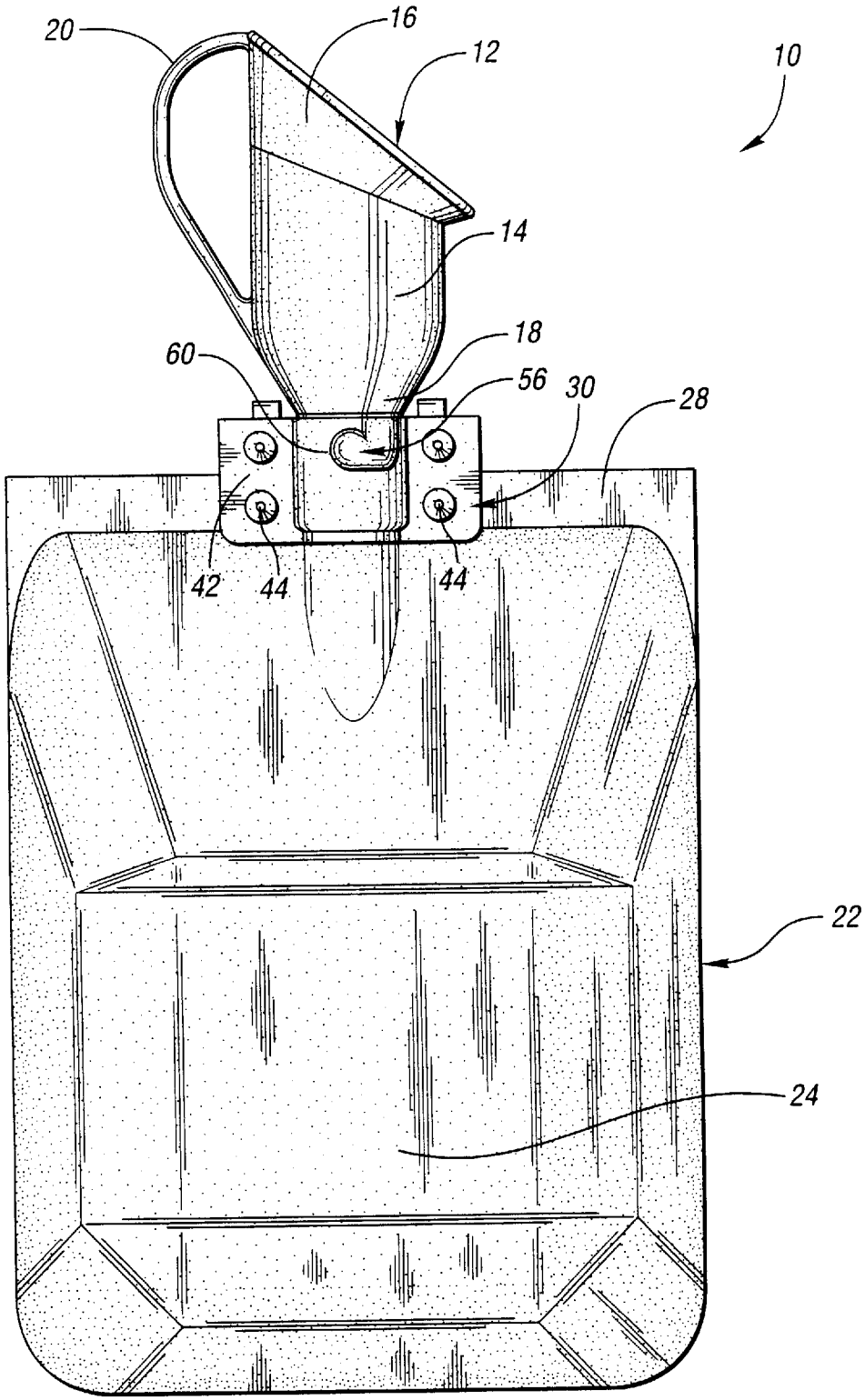
FIG. 2*b* is a rear elevational view of the portable urinal of FIG. 1.
Figure 6:
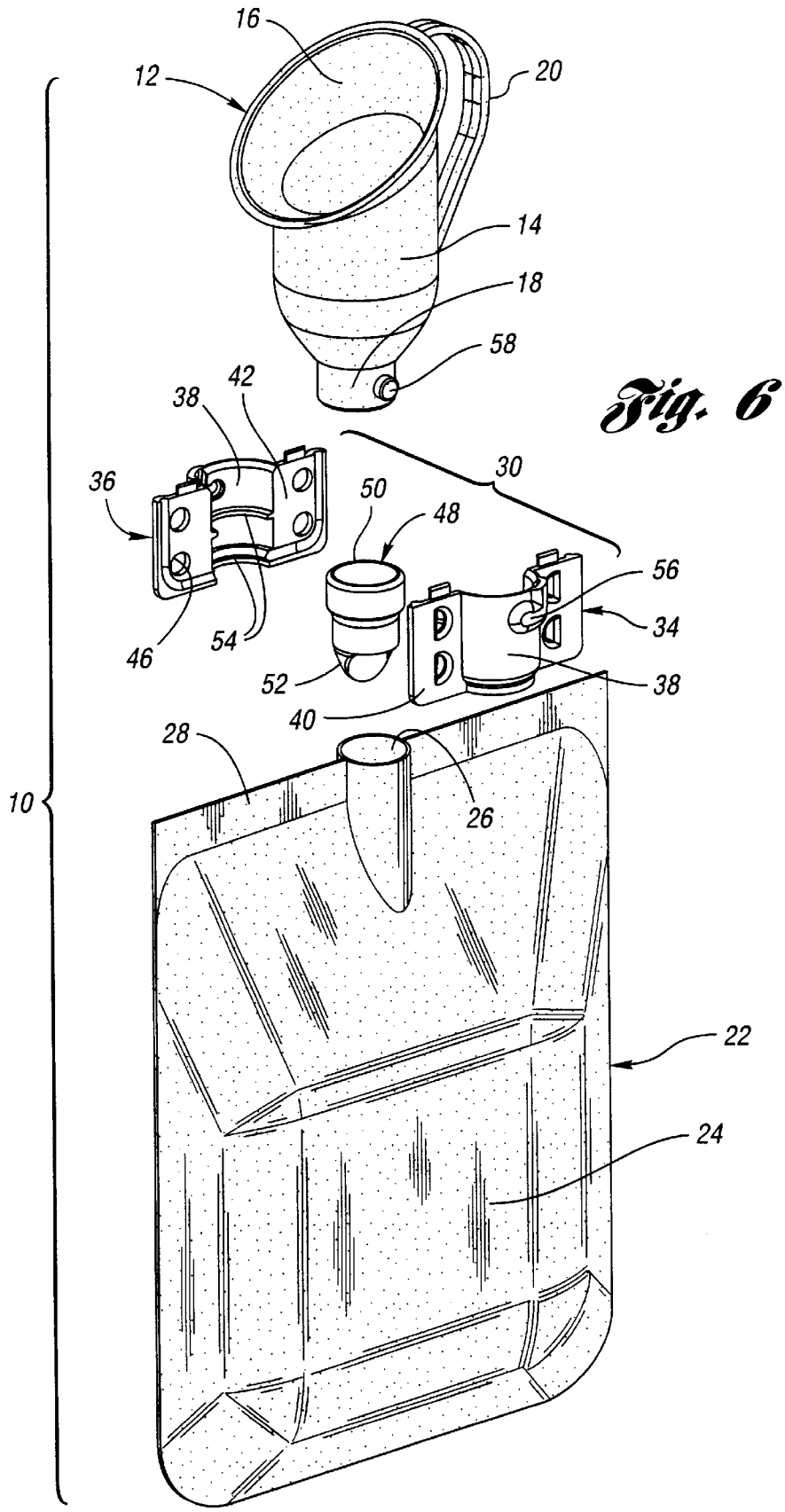
FIG. 6 is an exploded perspective view of the portable urinal of FIG. 1.
Figure 7:
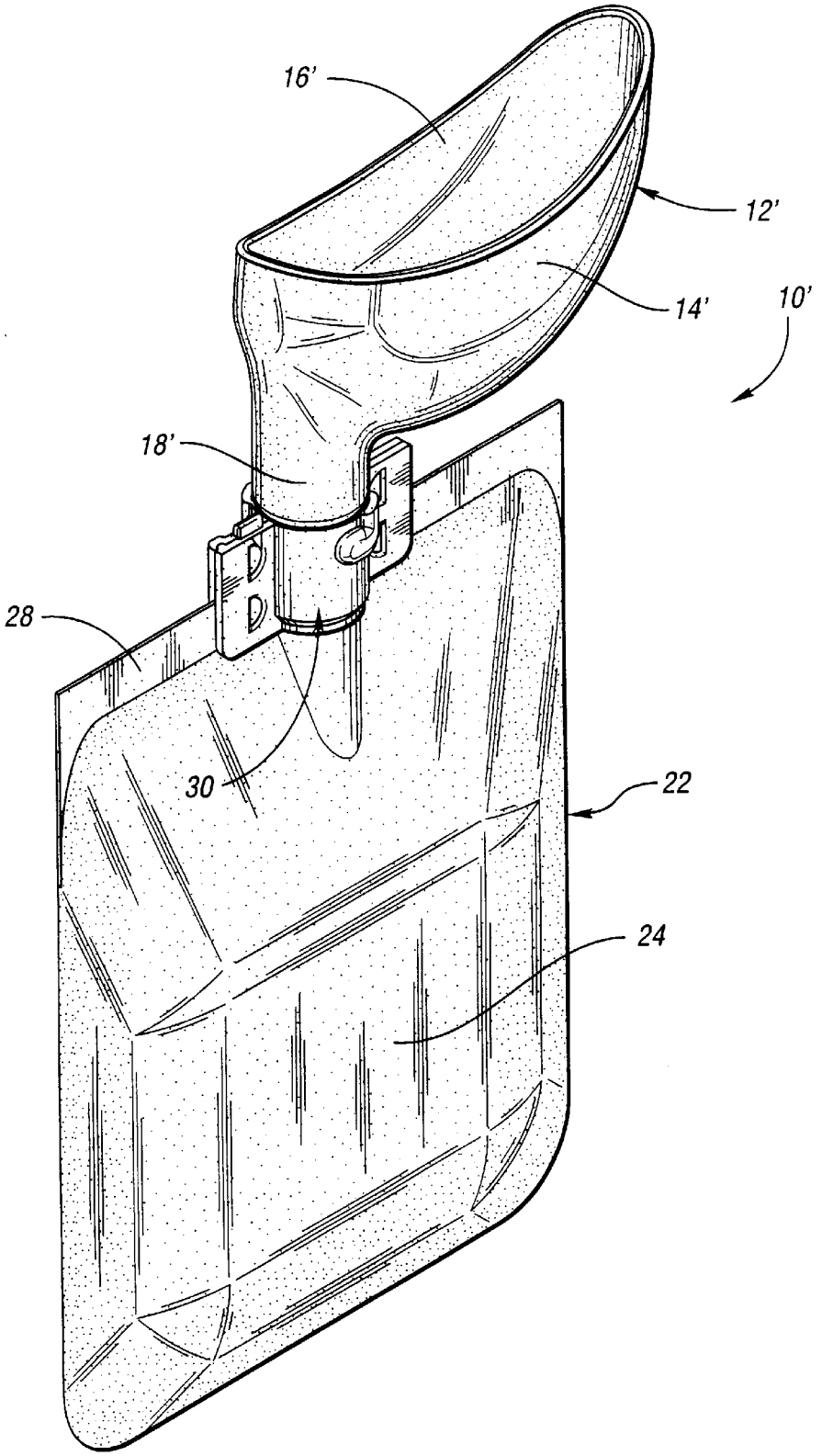
FIG. 7 is a perspective view of a second embodiment of the portable urinal according to the present invention, wherein a female receptacle is utilized.
Figure 8:
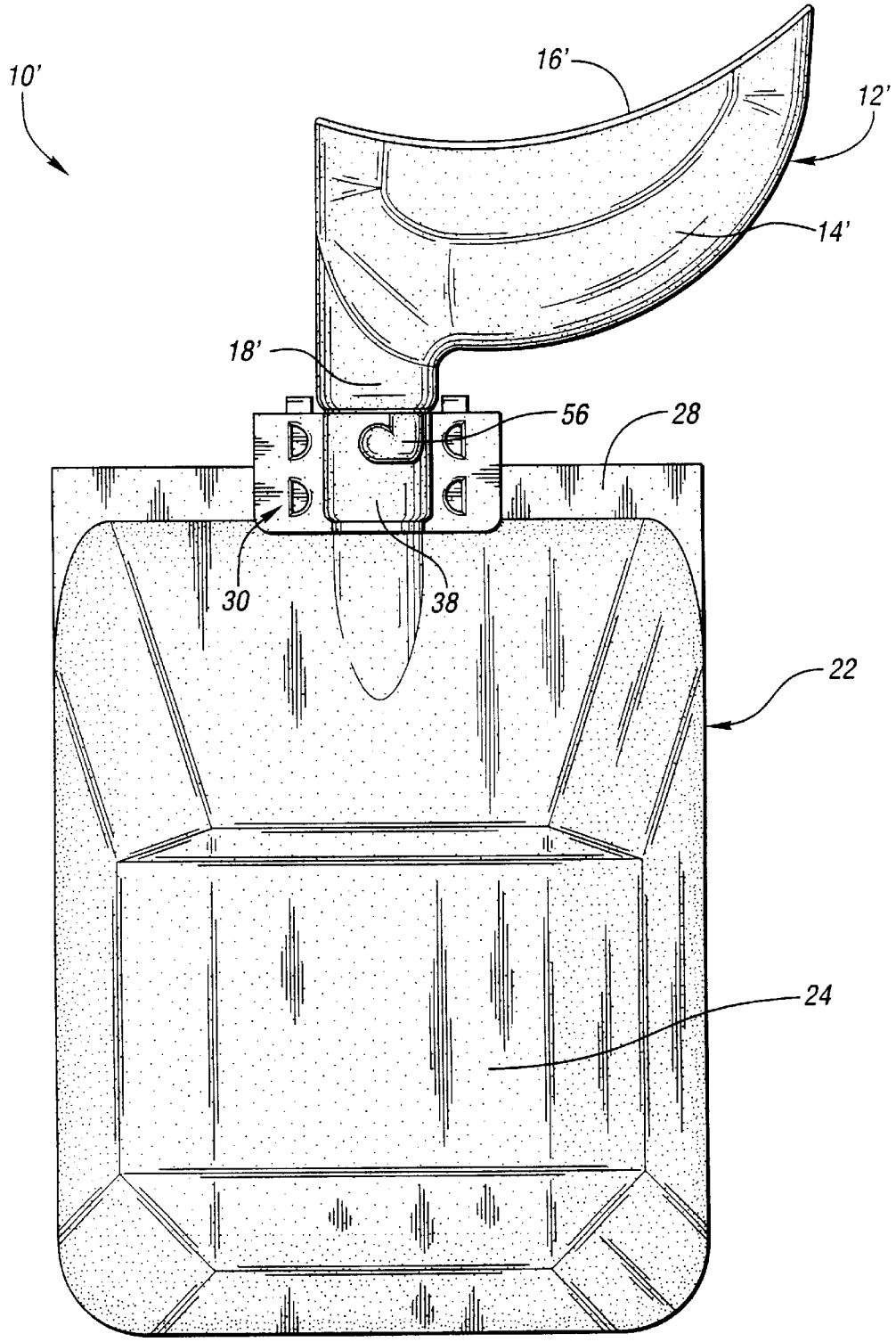
FIG. 8 is a front elevational view of the portable urinal of FIG. 7.
Figure 9:
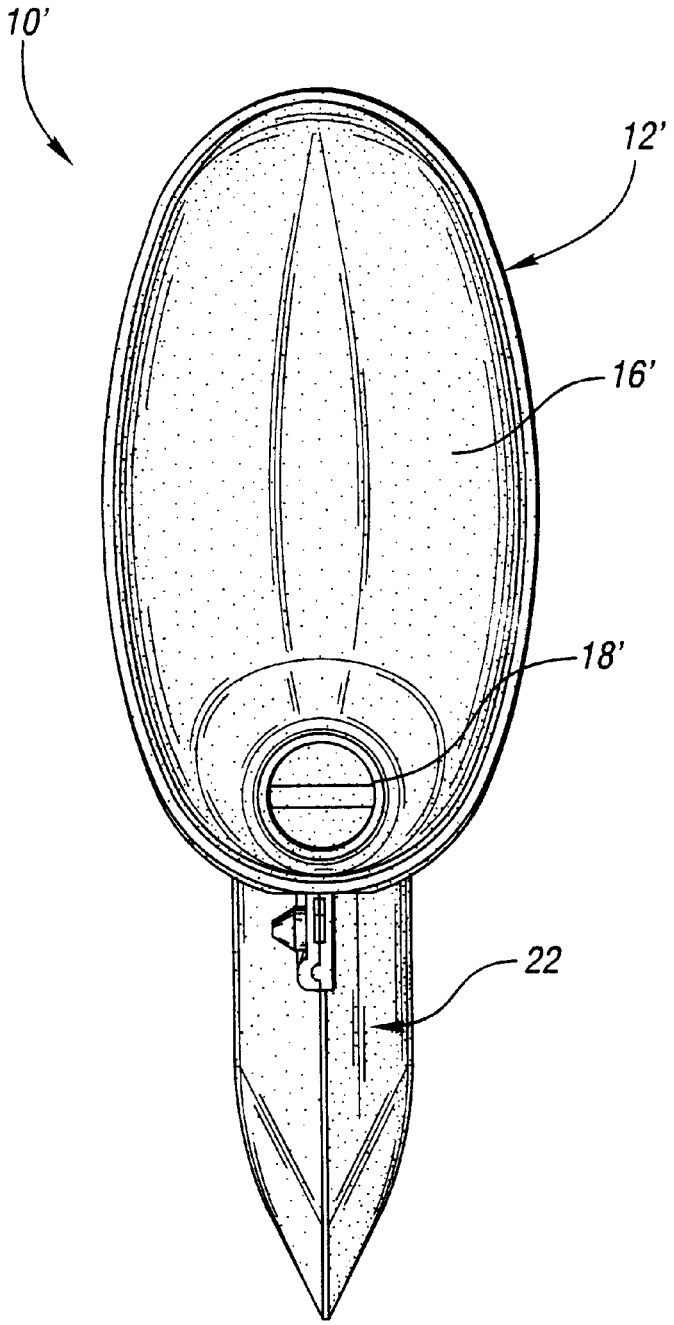
FIG. 9 is a top plan view of the portable urinal of FIG. 7.
Figure 10:
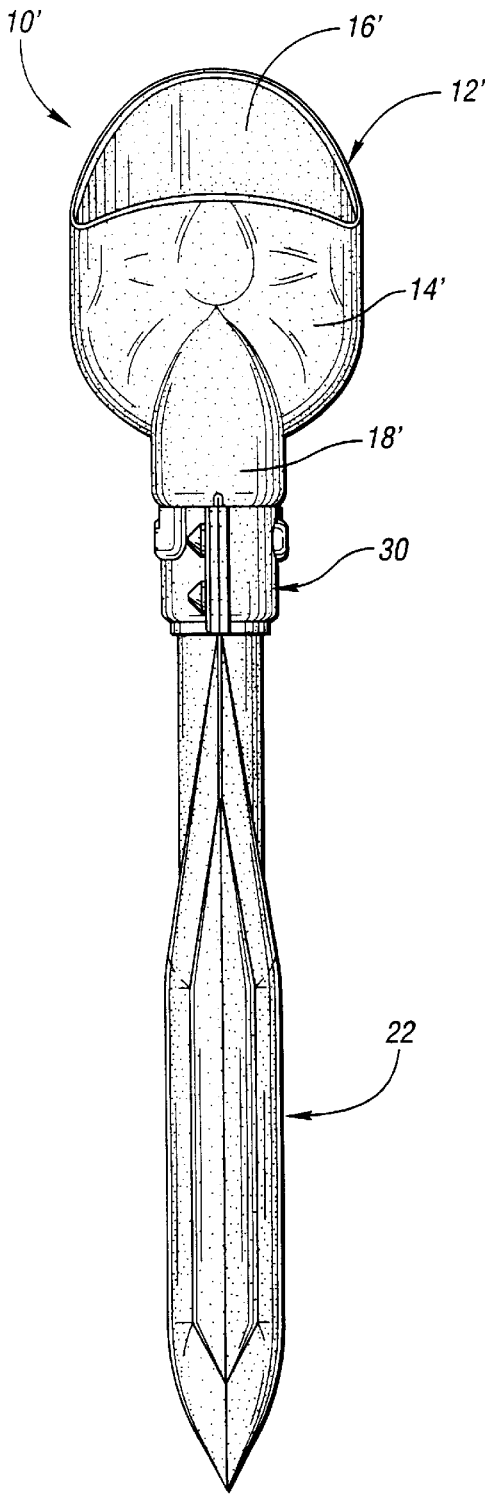
FIG. 10 is a left side elevational view of the portable urinal of FIG. 7.
Figure 11:
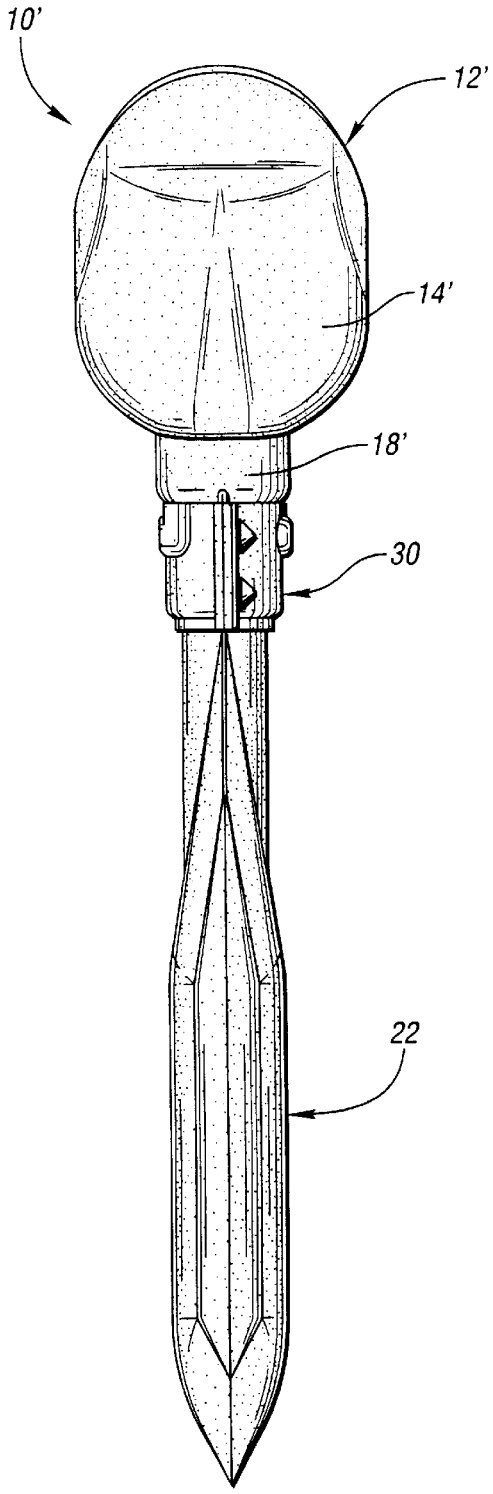
FIG. 11 is a right side elevational view of the portable urinal of FIG. 7.
Figure 12:
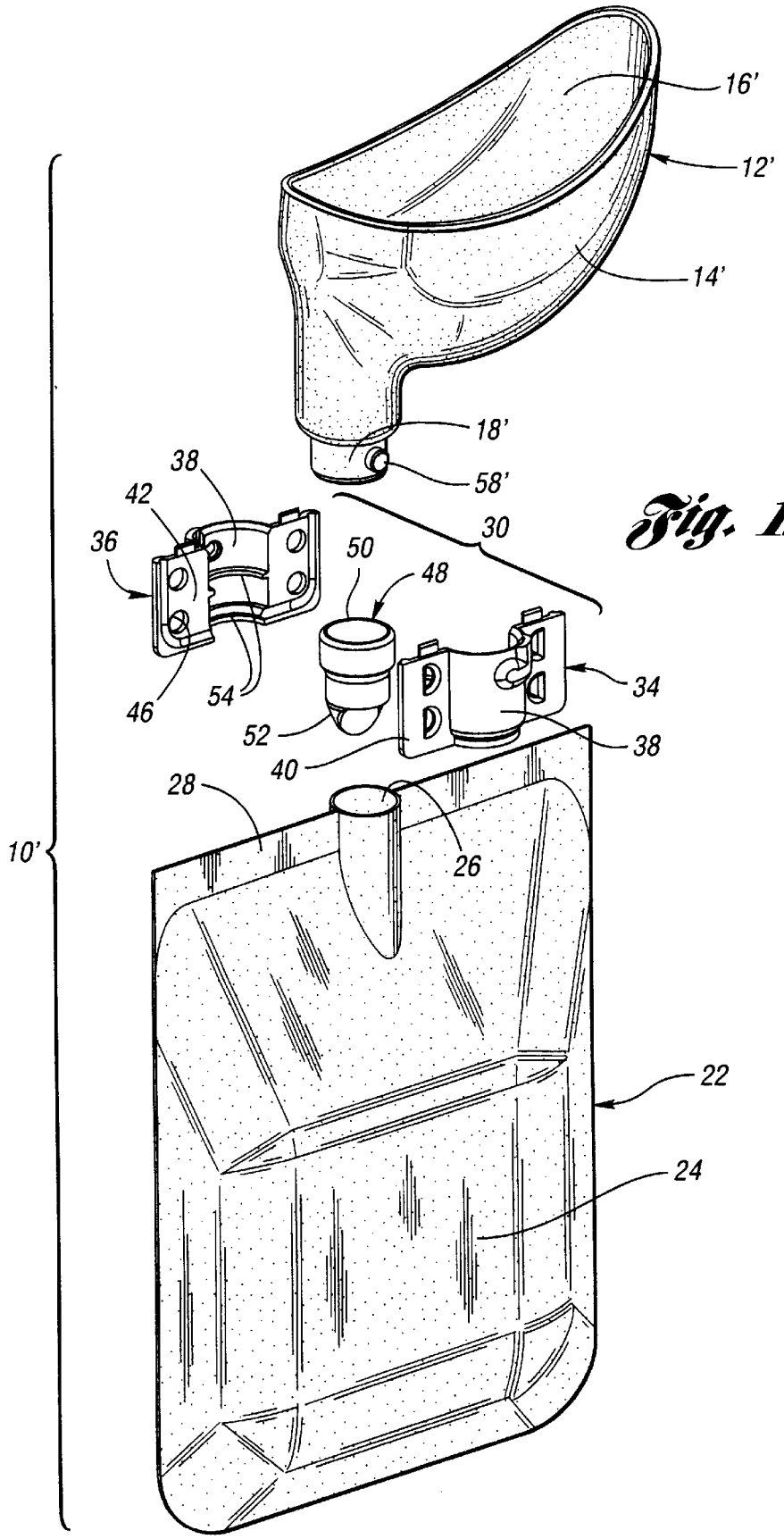
FIG. 12 is an exploded perspective view of the portable urinal of FIG. 7.

Referring to FIGS. 1–6, illustrated is a first embodiment of a portable urinal 10 for collecting and storing urine from a user according to the present invention. Portable urinal 10 includes a receptacle 12 for collecting the urine, where receptacle 12 includes a body portion 14 having an inlet 16 and a relatively smaller outlet 18 spaced from the inlet 16. In the embodiment depicted in FIGS. 1–6, receptacle inlet 16 and body portion 14 are sized and shaped to sufficiently receive the genitourinary area of a typical male user for directing the urine strewn into the receptacle 12. As shown, body portion 14 of male receptacle 12 is generally cylindrical in shape, widening proximally to form receptacle inlet 16 which is angled toward the user. At its distal end, body portion 14 terminates in receptacle outlet 18 of relatively smaller diameter. Although receptacle outlet 18 is smaller than receptacle inlet 16, the diameter of outlet 18 is large enough to avoid urine pooling in receptacle 12.

In a preferred embodiment, receptacle 12 is molded of a thermoplastic material such as polypropylene or other suitable material, and is designed to be smooth, durable, and reusable. Advantageously, portable urinal 10 can be positioned to collect urine whether the user is standing or sitting. As best shown in FIGS. 1–6, receptacle body portion 14 can include a handle 20 formed therein to improve ease of use. Handle 20 reduces the amount of hand dexterity needed to position receptacle 12 properly with respect to the user's genitourinary area.

Portable urinal 10 according to the present invention is capable of accommodating both male and female users. Turning now to FIGS. 7–12, a second embodiment of the portable urinal 10' is depicted in which a female receptacle 12' is utilized. The reference numerals for portable urinal 10' of FIGS. 7–12 correspond generally with the reference numerals for portable urinal 10 (having male receptacle 12) of FIGS. 1–6 with the addition of a prime "'" designation. In contrast to male receptacle 12, inlet 16' of female receptacle 12' has a wide oval shape in order to sufficiently receive the genitourinary area of a typical female user. Body portion 14' slopes downwardly from inlet 16' toward a smaller outlet 18' in the direction of the user. As with male receptacle 12, outlet 18' of female receptacle 12' is of sufficient diameter to avoid the pooling of urine. As described below, male receptacle 12 and female receptacle 12' are easily interchanged, allowing for optimal urine collection from both male and female users.

Figure 26:
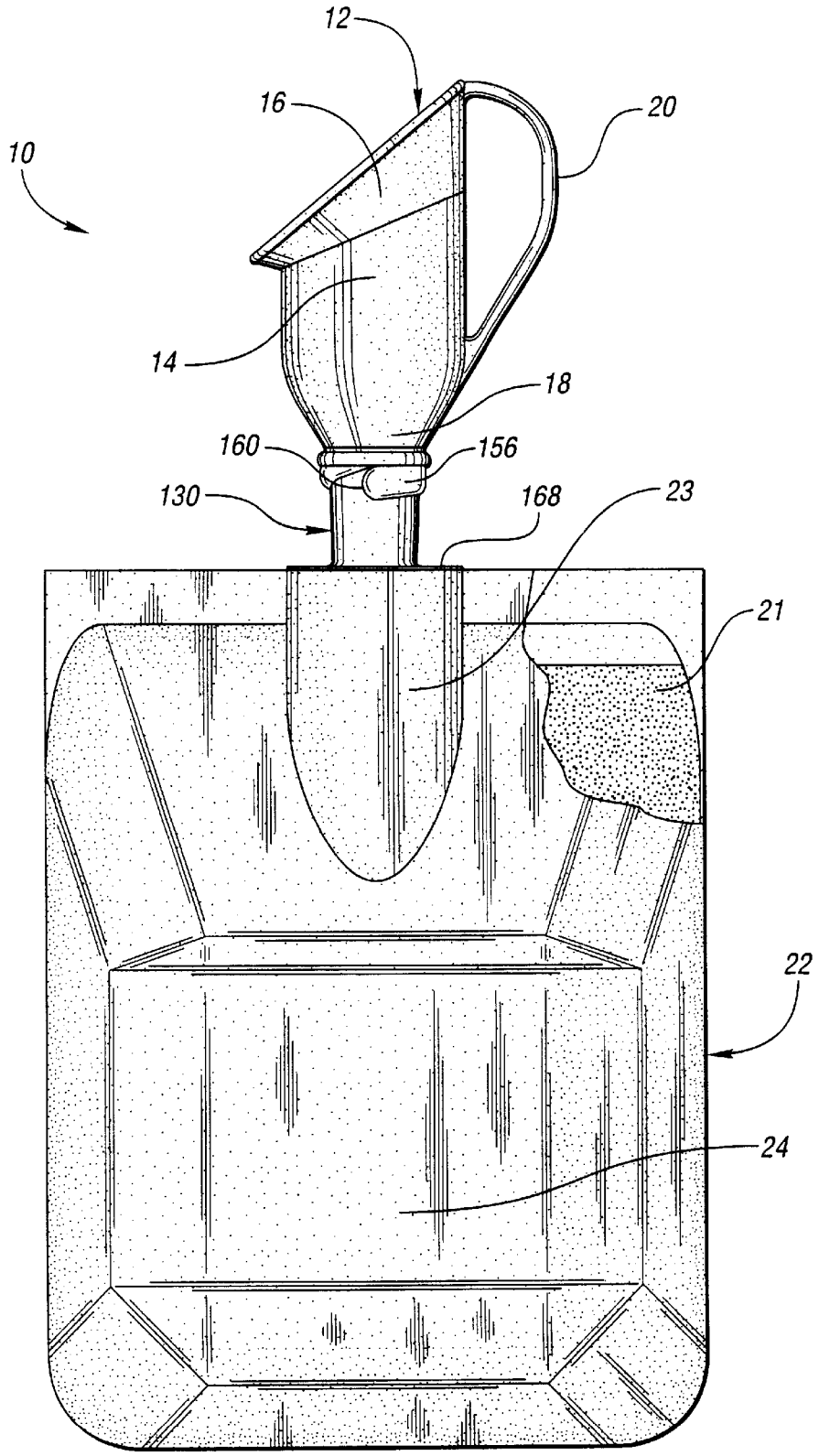
FIG. 26 is a front elevational view of the portable urinal of FIG. 25.
Figure 27:
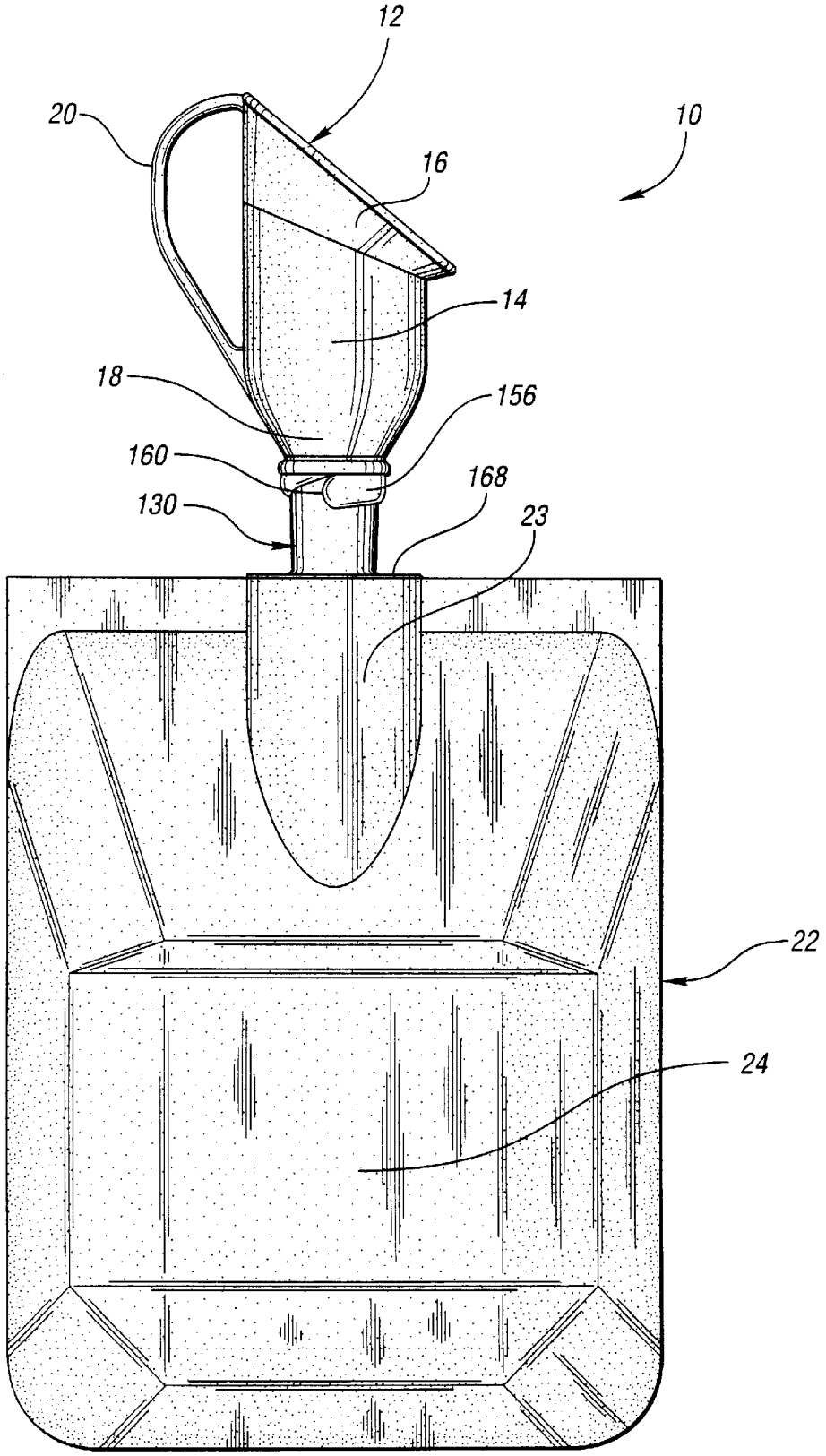
FIG. 27 is a rear elevational view of the portable urinal of FIG. 25.
Figure 29:
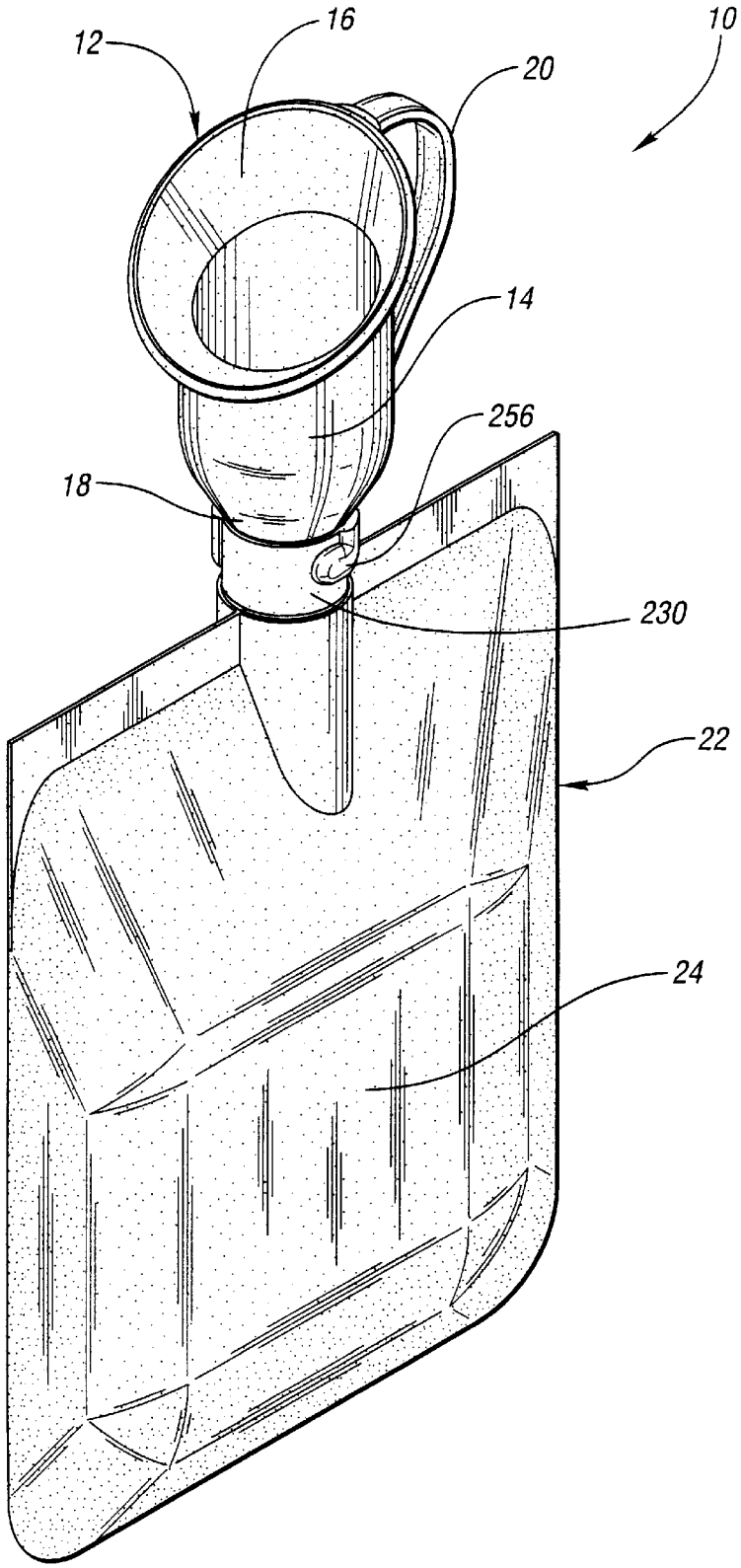
FIG. 29 is a perspective view of the portable urinal wherein the male receptacle and the connector of FIG. 28 are utilized.
Figure 30:
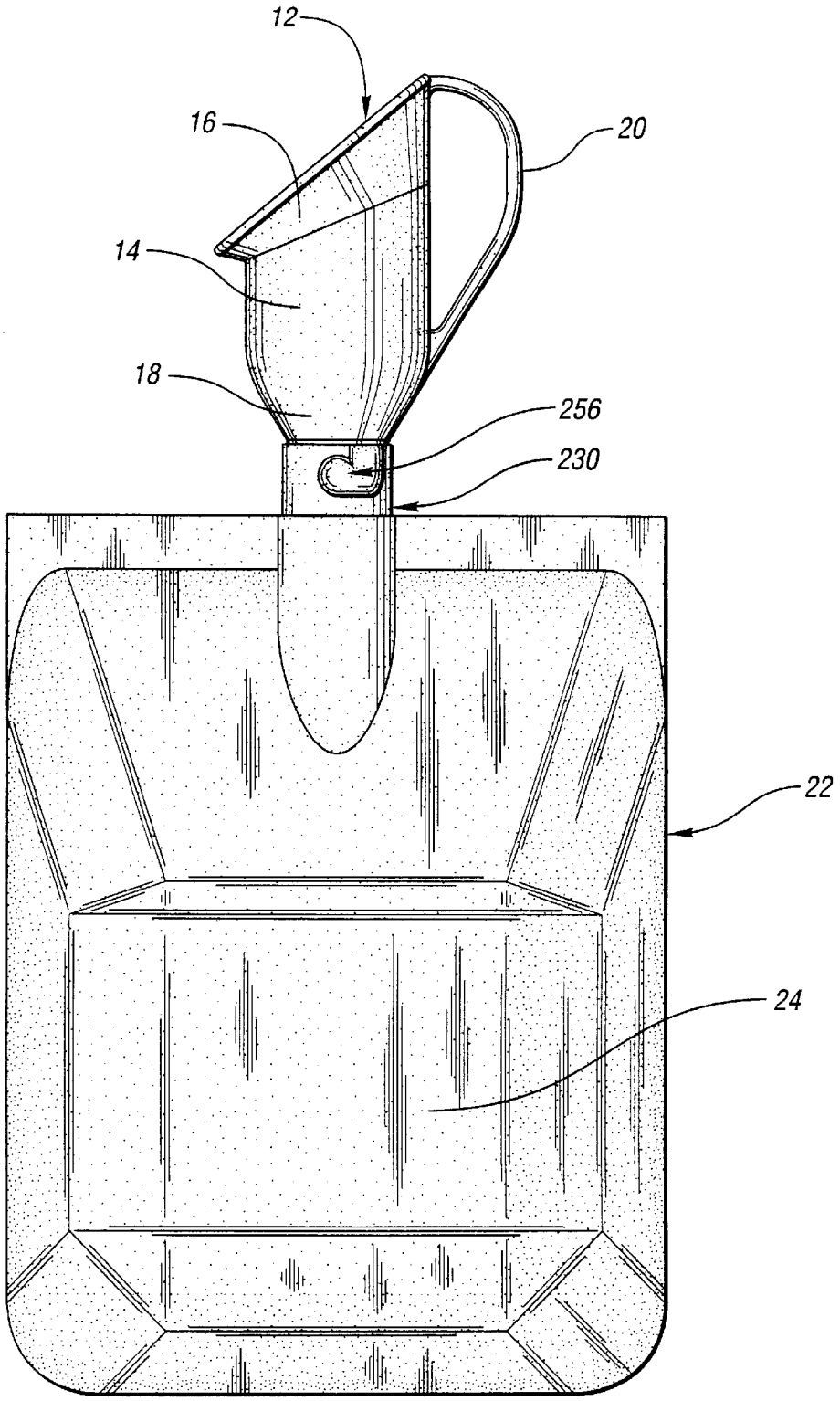
FIG. 30 is a front elevational view of the portable urinal of FIG. 29.
Figure 31:
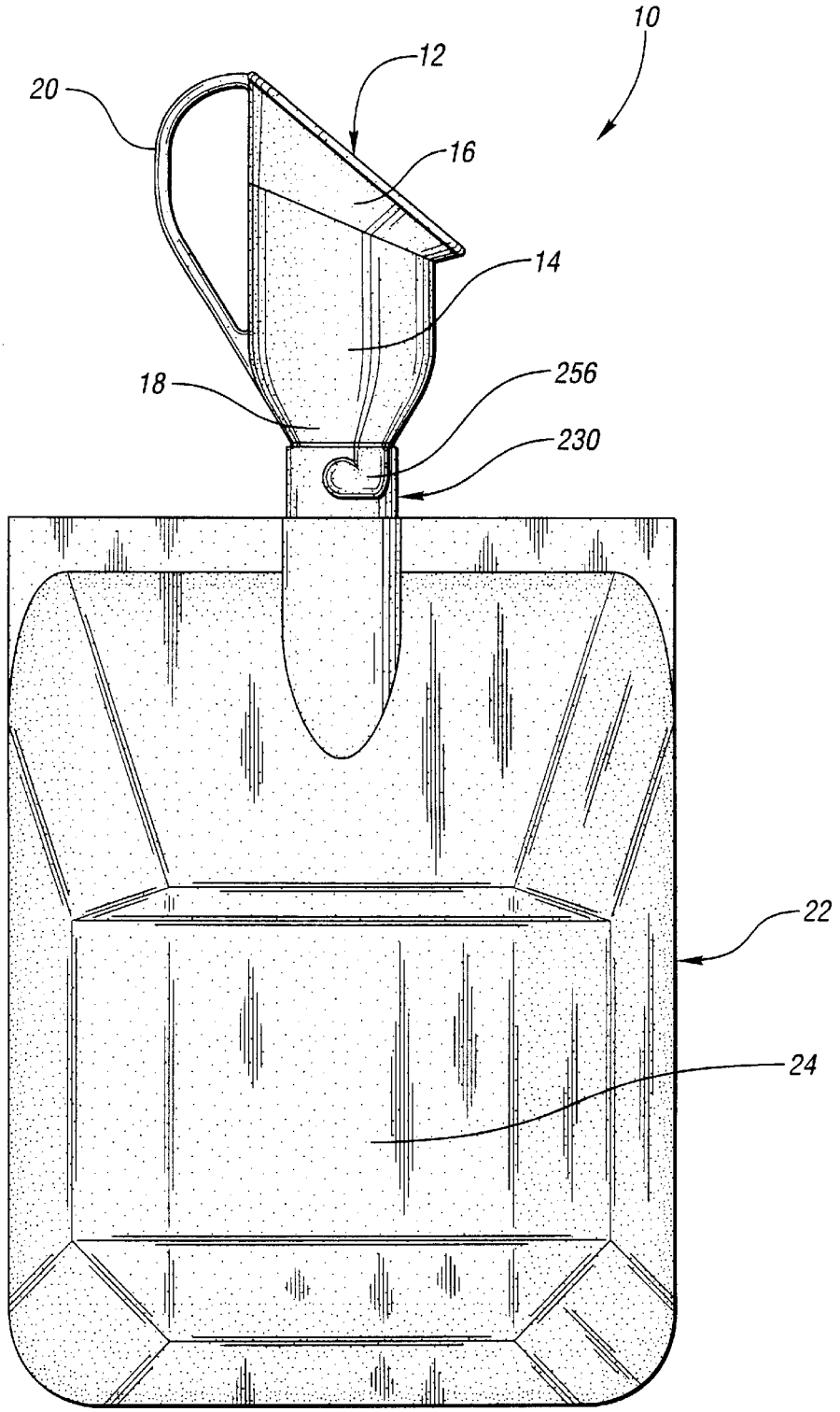
FIG. 31 is a rear elevational view of the portable urinal of FIG. 29.

Referring again to FIGS. 1–12, portable urinal 10 further includes a storage container 22 for storing the collected urine. In the preferred embodiment shown herein, storage container 22 comprises a flexible storage bag constructed from plastic, rubber, or another suitable material which is capable of containing human urine therein. Prior to use, storage bag 22 can be rolled up for compact storage. After use, storage bag 22 is designed to be disposable. Storage bag 22 is constructed to be leak resistant and waterproof, so as to provide for the containment of urine until storage bag 22 can be disposed of conveniently. As further leakage protection, storage bag 22 preferably includes a powder substance 21 (see FIG. 26) contained therein for absorbing the urine. More particularly, each storage bag 22 is preferably pre-filled with a sanitizing gelling powder which includes a combination of absorbing polymers and enzymes to quickly deodorize and solidify the urine into a condensed gel.

Figure 13:
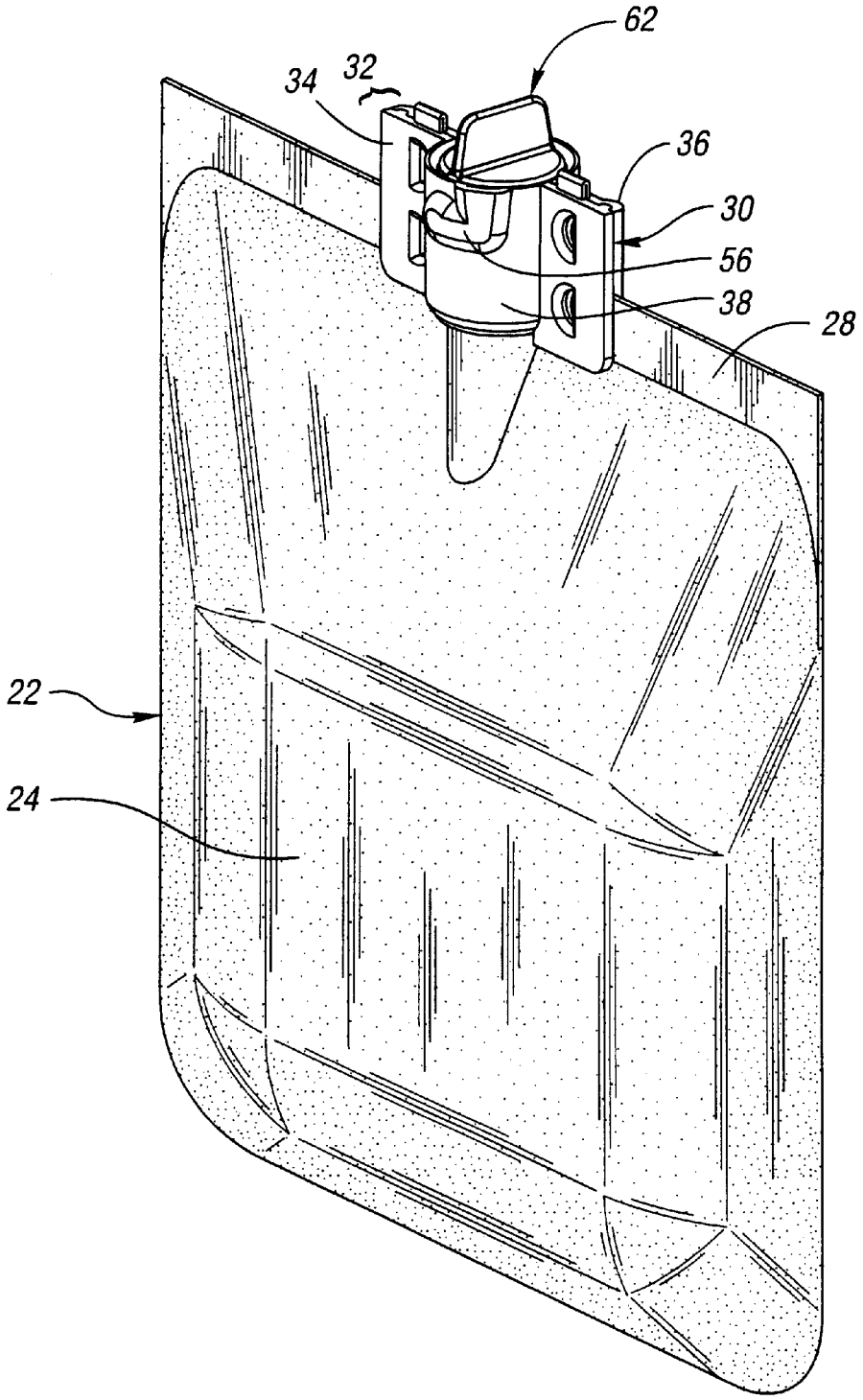
FIG. 13 is a perspective view of a third embodiment of the portable urinal according to the present invention, wherein a cap is utilized to seal the storage container.
Figure 14:
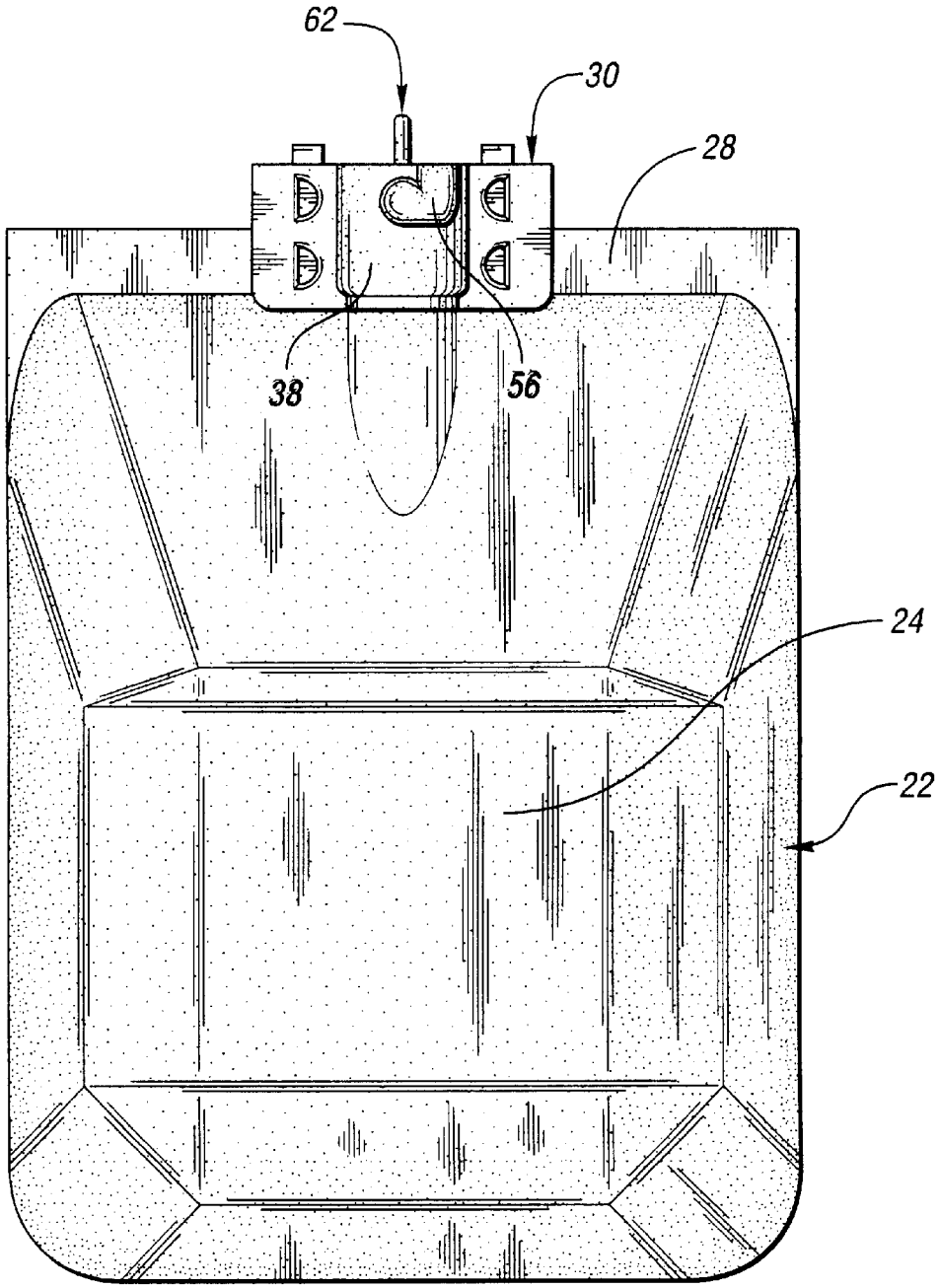
FIG. 14 is a front elevational view of the portable urinal of FIG. 13.
Figure 15:
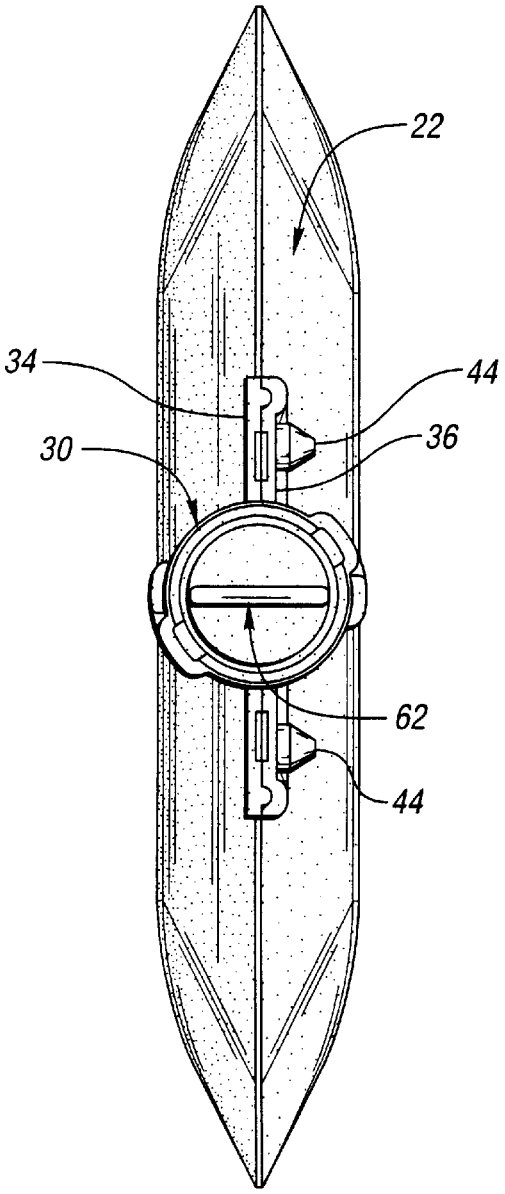
FIG. 15 is a top plan view of the portable urinal of FIG. 13.
Figure 16:
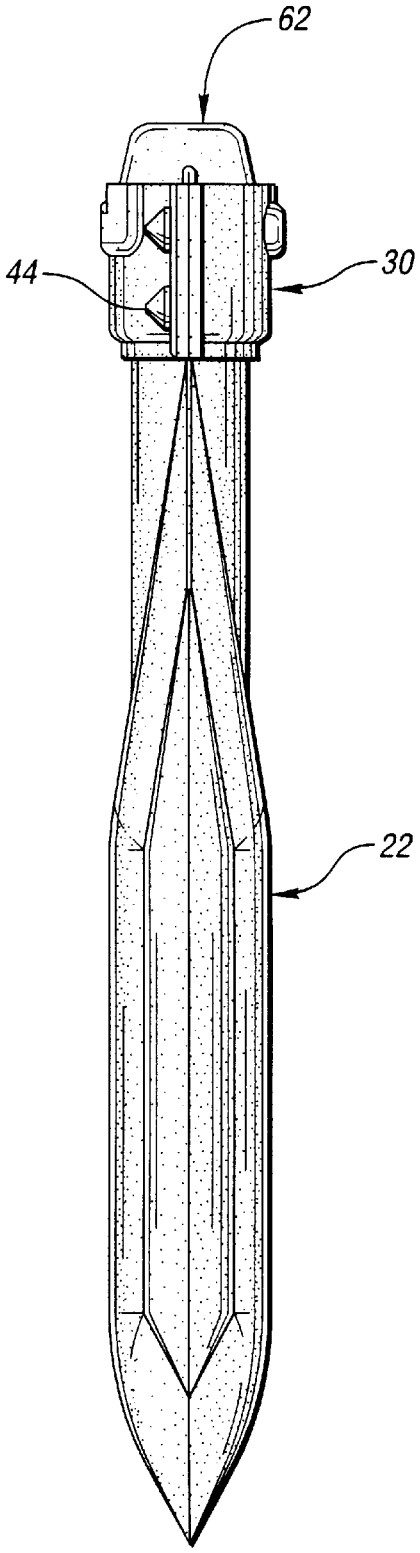
FIG. 16 is a left side elevational view of the portable urinal of FIG. 13.
Figure 17:
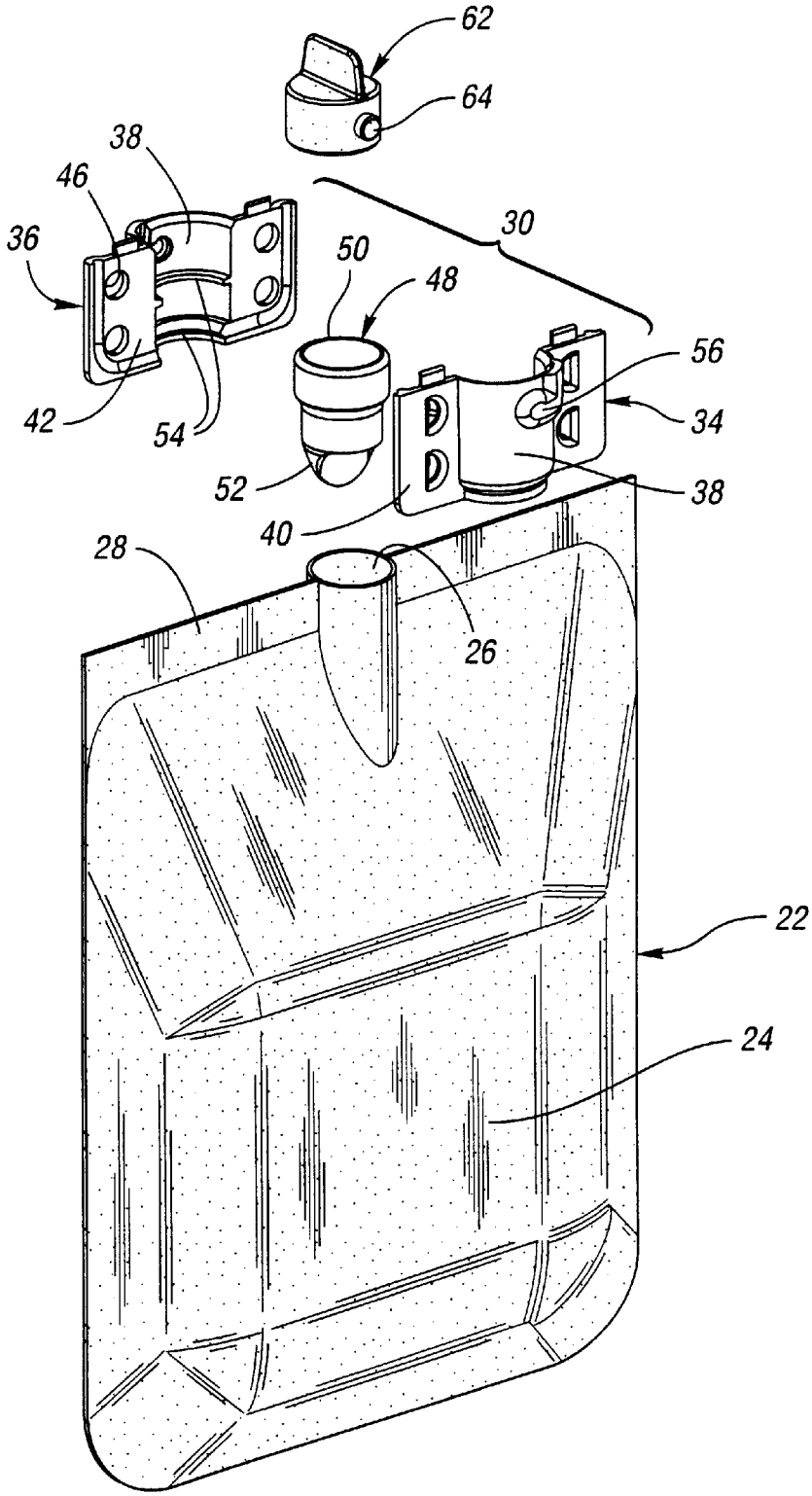
FIG. 17 is an exploded perspective view of the portable urinal of FIG. 13.
Figure 18:
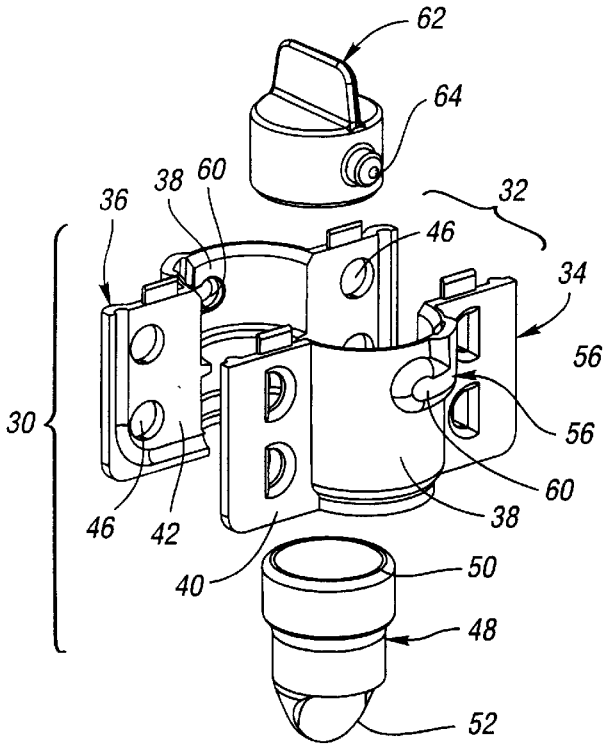
FIG. 18 is an exploded, perspective view of the connector and cap according to the present invention.
Figure 19:
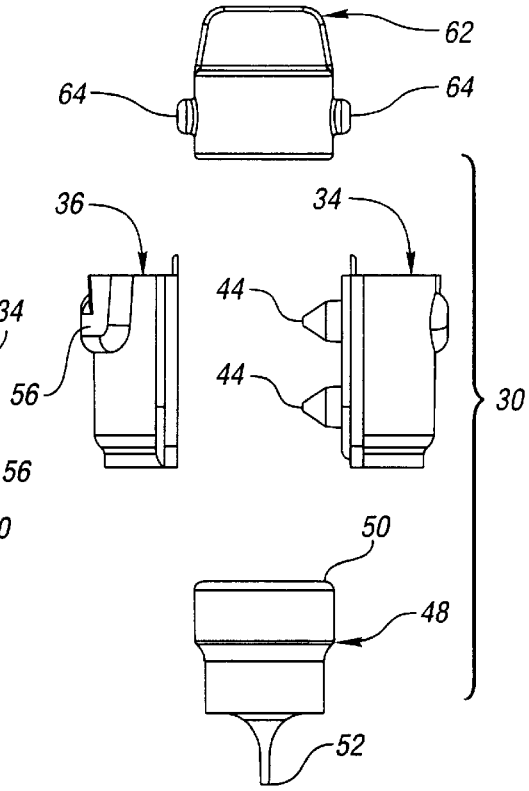
FIG. 19 is an exploded, front elevational view of the connector and cap.
Figure 20:
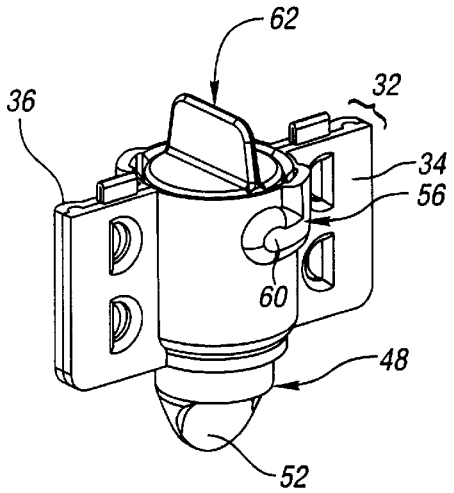
FIG. 20 is a perspective view of the assembled connector and cap.
Figure 21:
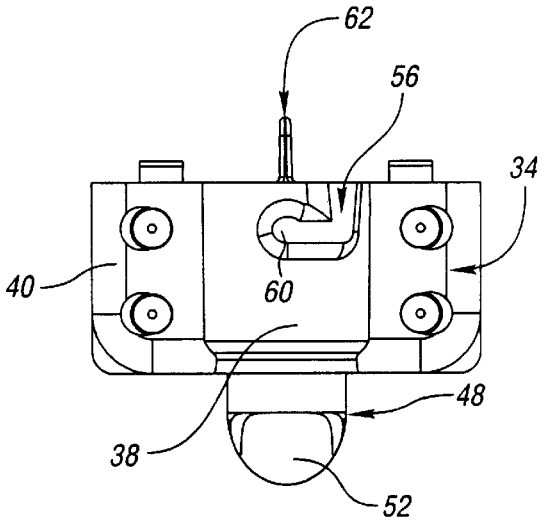
FIG. 21 is a right side elevational view of the assembled connector and cap.
Figure 22:
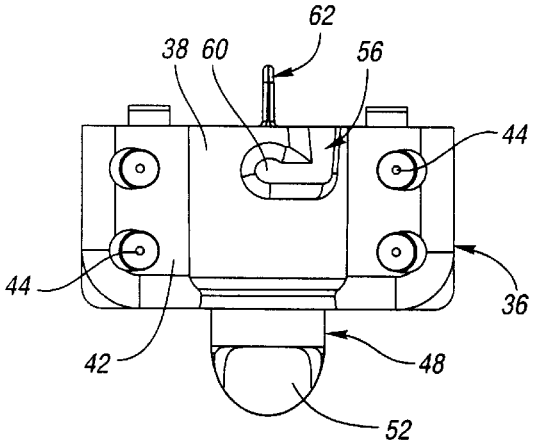
FIG. 22 is a left side elevational view of the assembled connector and cap.
Figure 23:
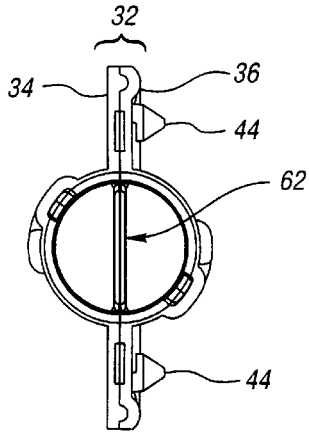
FIG. 23 is a top plan view of the assembled connector and cap.
Figure 24:
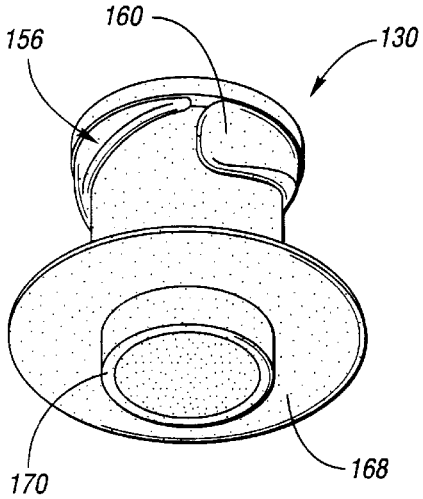
FIG. 24 is a perspective view of a second embodiment of the connector in accordance with the present invention.
Figure 28:
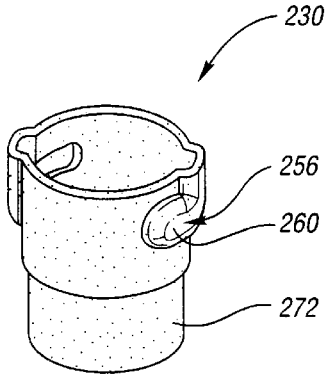
FIG. 28 is a perspective view of a third embodiment of the connector in accordance with the present invention.
Figure 25:
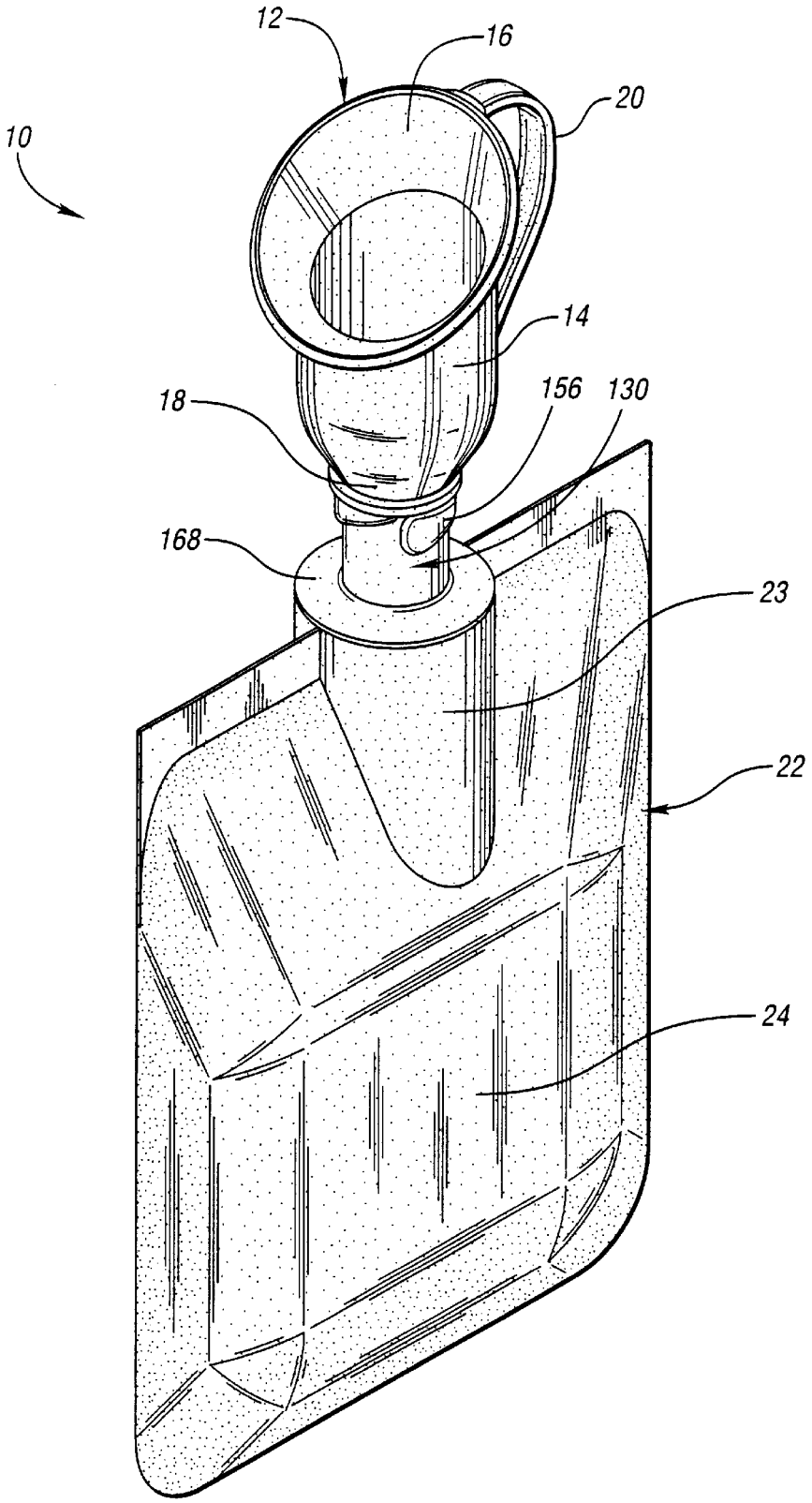
FIG. 25 is a perspective view of the portable urinal wherein the male receptacle and the connector of FIG. 24 are utilized.

Storage bag 22 includes a lower body 24 with a hollow interior, and an inlet 26 (FIG. 6) extending upwardly from the lower body 24 for receiving the urine from receptacle 12, 112. On both sides of inlet 26, storage bag 22 includes a generally flat seam region 28. In one embodiment, a connector 30 is press fit onto seam region 28 so as to receive storage bag inlet 26 therein as shown, for example, in FIGS. 1, 7, and 13. As shown in FIGS. 17–23, and as best shown in the exploded views of FIG. 6, 12, and 17–19, connector 30 includes a bracket 32 having first 34 and second 36 bracket members. Each bracket member 34, 36 includes a central concave portion 38 sized to receive inlet 26 when assembled, and generally flat exterior attachment panels 40, 42, respectively, that serve to secure the first 34 and second 36 bracket members together. More specifically, attachment panels 40 of first bracket member 34 include projections 44 extending inwardly from its inner surface, and attachment panels 42 of second bracket member 36 include apertures 46 sized to receive the projections 44 in order to secure first bracket member 34 to second bracket member 36.

Still referring to FIGS. 6, 12, and 17–19, connector 30 further includes a funnel 48 enclosed and supported by bracket 32. Funnel 48 is generally cylindrical and includes an inlet portion 50 for preferably engaging receptacle outlet 18, 118. Funnel 48 further includes an outlet portion 52 that protrudes below bracket 32 and is adapted to be received in storage bag inlet 26. Storage bag inlet 26, therefore, is disposed between bracket members 34, 36 and funnel 48 which serves to ensure that inlet 26 remains open for receiving the collected urine. As shown, funnel inlet portion 50 has a larger diameter than funnel outlet portion 52. First 34 and second 36 bracket members include a set of internal flanges 54 or ribs between which funnel inlet portion 50 is received such that axial movement of funnel 48 with respect to bracket members 34, 36 is prohibited.

As shown in FIGS. 24–27, a second embodiment of connector 130 is adapted to be welded onto storage bag 22 via vibration welding, ultrasonic welding, or other suitable plastic joining techniques. The reference numerals for connector 130 of FIGS. 24–27 correspond generally with the reference numerals for connector 30 of FIGS. 1–23 except for the addition of a "1" prefix. In contrast to connector 30, connector 130 is formed as a one piece cylindrical part having a flange 168, shown as annular in shape. Flange 168 contacts a neck region 23 of storage bag 22, wherein neck region 23 includes a corresponding flange to which flange 168 is welded. A distal end 170 of connector 130 is adapted to be received in storage bag inlet 26.

With reference to FIGS. 28–31, a third embodiment of connector 230 is shown, wherein the reference numerals for connector 230 correspond generally with the reference numerals for connector 30 of FIGS. 1–23 except for the addition of a "2" prefix. As with connector 130, connector 230 is formed as a one piece cylindrical part which is adapted to be welded onto storage bag 22. More particularly, a distal end 272 of connector 230 is adapted to be received in storage bag inlet 26 and then welded thereto.

As best shown in FIGS. 18–23, concave portions 38 of bracket members 34, 36 each include a generally L-shaped slot or groove 56 formed therein. Likewise, connector 230 of FIGS. 28–31 includes generally L-shaped slots 256, and connector 130 of FIGS. 24–27 includes slots or grooves 156 formed therein which extend partially around connector 130 in a generally helical pattern. Each slot 56, 156, 256 is sized to slidingly receive a projection 58, 158 formed on receptacle outlet 18, 18'. For assembly, projections 58, 58' are aligned with slots 56, 156, 256 and receptacle 12, 12' is moved into contact with connector 30, 130, 230. Receptacle 12, 12' is then secured to connector 30, 130, 230 by rotating receptacle 12, 12' in a first direction with respect to connector 30, 130, 230 such that projections 58, 58' are moved to ends 60, 160, 260 of slots 56, 156, 256. In this way, connector 30, 130, 230 is operable to releasably join receptacle 12, 12' with storage bag 22, allowing the urine to flow from receptacle outlet 18, 18' into storage container inlet 26. For disassembly, receptacle 12, 12' can be removed from storage bag 22 by rotating receptacle 12, 12' in the opposite direction with respect to connector 30, 130, 230 to move projections 58, 58' away from slot ends 60, 160, 260 and then lifting upwardly. Therefore, receptacle 12, 12' and storage bag 22 can be quickly assembled for use, and easily disassembled for storage, cleaning, or interchanging with another receptacle 12, 12'.

Referring now to FIGS. 13–23, a cap 62 is adapted to be received by connector 30, 130, 230 for sealing storage bag 22 following removal of receptacle 12, 12', allowing urine to be easily and safely stored within storage bag 22 for later disposal. Similar to receptacle outlet 18, 18', cap 62 includes projections 64 that are slidingly received in connector slots 56, 156, 256. In order to secure cap 62 to connector 30, 130, 230, cap projections 64 are aligned with slots 56, 156, 256, cap 62 is moved into contact with connector 30, 130, 230, and then cap 62 is rotated in a first direction with respect to connector 30, 130, 230 such that projections 64 are moved to slot ends 60, 160, 260, thereby locking the cap 62 within connector 30, 130, 230. The sealed storage bag 22 can then be disposed and another, unused storage container 22 can be joined with receptacle 12 or 12' for subsequent use.

Although particular configurations of receptacle outlet 18, 118, cap 62, and connector 30, 130, 230 are shown and described herein, other configurations capable of allowing quick and easy assembly and disassembly of these components are fully contemplated in accordance with the present invention. For example, in an alternative embodiment of the present invention, funnel 48 can be eliminated and receptacle outlet 18, 118 or, alternatively, a distal end of cap 62 is extended and is received in storage container inlet 26.

Further, in accordance with the present invention, it is contemplated that a kit could be provided including male receptacle 12, female receptacle 112, and a plurality of storage bags 22 and caps 62. The kit would preferably further include disposable cleansing cloths (not shown) for personal hygiene purposes as well as for cleaning receptacle 12, 112. Since storage bags 22 can be collapsed and rolled up prior to use, such as kit would require little more space than the volume of the male and female receptacles. The kit could be furnished in a carry bag that can be stored in a compact space, such as the glove compartment of a car.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A portable urinal for collecting and storing urine from a user, comprising:

a substantially rigid, one-piece receptacle for collecting the urine, the receptacle including a body portion having an inlet portion and an outlet portion, the inlet portion sized to sufficiently receive the genitourinary area of the user;

a flexible storage container for storing the urine, the storage container having a body and an inlet for receiving the urine from the receptacle, the storage container inlet comprising a passageway for urine between an exterior of the storage container and the storage container body; and a rigid connector attached to the storage container wherein a distal outlet end of the connector is received in within the storage container inlet casing the storage container inlet to remain open for the passage of urine into the storage container body, the connector having an inlet for removably receiving the receptacle outlet portion such that the connector releasably joins the receptacle with the storage container allowing the urine to flow from the receptacle outlet portion into the storage container inlet.

2. The portable urinal according to claim 1, wherein the receptacle inlet portion is sized to receive the genitourinary area of a male user.

3. The portable urinal according to claim 1, wherein the receptacle inlet portion is sized to receive the genitourinary area of a female user.

4. The portable urinal according to claim 1, wherein the storage container includes a flexible bag.

5. The portable urinal according to claim 1, wherein the connector is welded to the storage container.

6. The portable urinal according to claim 5, wherein the storage container includes a neck region and the connector includes an annular flange arranged to be affixed to a corresponding flange of the container neck region.

7. The portable urinal according to claim 1, wherein the receptacle outlet includes at least one projection, and the connector includes at least one slot sized to slidingly receive the projection.

8. The portable urinal according to claim 7, wherein the receptacle is secured to the connector by rotating the receptacle with respect to the connector such that the projection is moved to an end of the slot.

9. The portable urinal according to claim 1, further including a cap adapted to be received by the connector for sealing the storage container following removal of the receptacle.

10. The portable urinal according to claim 9, wherein the cap includes at least one projection, and the connector includes at least one slot sized to slidingly receive the projection.

11. The portable urinal according to claim 10, wherein the cap is secured to the connector by rotating the cap with respect to the connector such that the projection is moved to an end of the slot.

12. The portable urinal according to claim 1, wherein the connector includes a bracket having first and second bracket members, and a funnel enclosed by the bracket, the funnel leaving an inlet portion for engaging the receptacle outlet and an outlet portion that protrudes below the bracket and is adapted to be received in the storage container inlet.

13. The portable urinal according to claim 12, wherein the first bracket member includes projections, and the second bracket member includes apertures sized to receive the projections to secure the first and second bracket members together.

14. The portable urinal according to claim 12, wherein the first and second brackets include a set of internal flanges between which the funnel inlet portion is received such that axial movement of the funnel with respect to the bracket members is prohibited.

15. The portable urinal according to claim 1, wherein the receptacle body portion includes a handle.

16. The portable urinal according to claim 1, wherein the storage container includes a powder substance contained therein for absorbing the urine.

17. The portable urinal according to claim 1, wherein the connector is press fit onto the storage container.

18. A portable urinal for collecting and storing urine from a user, comprising:

a substantially rigid, one-piece reusable receptacle for collecting the urine, the receptacle including a body portion having an inlet portion and a relatively smaller outlet portion, the inlet potion sized to sufficiently receive the genitourinary area of the user;

a disposable, flexible storage container for storing the urine, the storage container having a body and a relatively smaller neck region adjacent therein which includes an inlet for receiving urine from the receptacle;

a rigid connector attached to the storage container wherein a distal outlet end of the connector is received within the storage container inlet causing the neck region to remain open for the storage of urine into the storage container body, the connector having an annular flange arranged to be affixed to a corresponding flange of the container neck region, the connector having an inlet adapted to receive the receptacle outlet portion thereby allowing urine to flow from the receptacle outlet portion into the storage container inlet, the connector releasably joining the receptacle with the storage container such that the receptacle can be removed from the storage container; and a cap adapted to be received by the connector for sealing the storage container following removal of the receptacle, wherein the sealed storage container can be disposed and replaced with another, unused storage container.

19. The portable urinal according to claim 18, wherein the receptacle inlet portion is sized to receive the genitourinary area of a male user.

20. The portable urinal according to claim 18, wherein the receptacle inlet portion is sized to receive the genitourinary area of a female user.

21. The portable urinal according to claim 18, wherein the storage container includes a flexible bag.

22. The portable urinal according to claim 18, wherein the receptacle outlet portion includes at least one projection, and the connector includes at least one slot sized to slidingly receive the projection, wherein the receptacle is secured to the connector by rotating the receptacle with respect to the connector such that the projection is moved to an end of the slot.

23. The portable urinal according to claim 18, wherein the cap includes at least one projection, and the connector includes at least one slot sized to slidingly receive the projection, wherein the cap is secured to the connector by rotating the cap with respect to the connector such that the projection is moved to an end of the slot.

24. A portable urinal kit for collecting and storing urine, the kit comprising:

a substantially rigid, one-piece female receptacle for collecting urine from a female user, the female receptacle including a body portion having an inlet portion and a relatively smaller outlet portion, the inlet portion sized to sufficiently receive the genitourinary area of the female user;

a substantially rigid, one-piece male receptacle for collecting urine from a male user, the male receptacle including a body portion having an inlet portion and a relatively smaller outlet portion, the inlet portion sized to sufficiently receive the genitourinary area of the male user;

one or more disposable, flexible storage containers for storing the urine, each storage container having a body and an inlet for receiving urine from a selected one of the female and male receptacles, the storage container inlet comprising the final entrance into the storage container body;

a rigid connector attached to the storage container wherein a distal outlet end of the connector is received within the storage container causing the storage container inlet to remain open for the passage of urine into the storage container body, the connector having an inlet adapted to receive the outlet portion of the selected receptacle thereby allowing urine to flow from the selected receptacle outlet portion into the storage container inlet, the connector releasably joining the selected receptacle with the storage container such that the selected receptacle can be removed from the storage container; and a cap adapted to be received by the connector for sealing the storage container following removal of the selected receptacle, wherein the sealed storage container can be disposed and replaced with another, unused storage container.

25. The portable urinal kit according to claim 24, wherein the one or more storage containers include flexible bags.

26. The portable urinal kit according to claim 24, wherein each receptacle outlet portion includes at least one projection, and the connector includes at least one slot sized to slidingly receive the projection, wherein the selected receptacle is secured to the connector by rotating the selected receptacle with respect to the connector such that the projection is moved to an end of the slot.

27. The portable urinal kit according to claim 24, wherein the cap includes at least one projection, and the connector includes at least one slot sized to slidingly receive the projection, wherein the cap is secured to the connector by rotating the cap with respect to the connector such that the projection is moved to an end of the slot.

28. The portable urinal kit according to claim 24, wherein the connector is press fit onto the storage container and includes a bracket and a funnel enclosed by the bracket, the funnel having an inlet portion for engaging the selected receptacle outlet and an outlet portion that protrudes below the bracket and is adapted to be received in the storage container inlet.

29. The portable urinal kit according to claim 24, wherein the storage container includes a neck region and the connector includes an annular flange arranged to be affixed to a corresponding flange of the container neck region.

30. The portable urinal kit according to claim 24, wherein the male receptacle body portion includes a handle.

31. The portable urinal kit according to claim 24, wherein the one or more storage containers each include a powder substance contained therein for absorbing the urine.

* * * * *

UNITED STATES PATENT AND TRADEMARK OFFICE

CERTIFICATE OF CORRECTION

PATENT NO. : 6,684,414 B1
DATED : February 3, 2004
INVENTOR(S) : Houston Rehrig

It is certified that error appears in the above-identified patent and that said Letters Patent is hereby corrected as shown below:

Column 7,
Line 31, before “within” delete “in
Line 31, delete “casing” and insert therefor
-- causing --.
Line 53, after “outlet” insert -- portion --.

Column 8,
Line 8, delete “leaving” and insert therefor -- having --.
Line 17, delete “brackets” and insert therefor -- bracket members --.
Line 33, delete “potion” and insert therefor -- portion --.
Line 37, delete “therein” and insert therefor -- thereto --.

Signed and Sealed this

Twenty-ninth Day of June, 2004

JON W. DUDAS
*Acting Director of the United States Patent and Trademark Office*